US011607780B2

(12) United States Patent
Ikuta et al.

(10) Patent No.: US 11,607,780 B2
(45) Date of Patent: Mar. 21, 2023

(54) WORK TOOL

(71) Applicant: MAKITA CORPORATION, Anjo (JP)

(72) Inventors: Hiroki Ikuta, Anjo (JP); Shogo Tominaga, Anjo (JP)

(73) Assignee: MAKITA CORPORATION, Anjo (JP)

( * ) Notice: Subject to any disclaimer, the term of this patent is extended or adjusted under 35 U.S.C. 154(b) by 117 days.

(21) Appl. No.: 16/966,795

(22) PCT Filed: Feb. 7, 2019

(86) PCT No.: PCT/JP2019/004494
§ 371 (c)(1),
(2) Date: Jul. 31, 2020

(87) PCT Pub. No.: WO2019/159819
PCT Pub. Date: Aug. 22, 2019

(65) Prior Publication Data

US 2021/0039230 A1 Feb. 11, 2021

(30) Foreign Application Priority Data

Feb. 19, 2018 (JP) ..... JP2018-027413
Feb. 19, 2018 (JP) ..... JP2018-027415
Jan. 8, 2019 (JP) ..... JP2019-001286

(51) Int. Cl.
*B25B 21/00* (2006.01)
*B25F 5/00* (2006.01)

(52) U.S. Cl.
CPC ..... *B25B 21/00* (2013.01); *B25F 5/001* (2013.01)

(58) Field of Classification Search
CPC ..... B25F 5/001; B25B 23/157; B25B 23/15; B25B 21/00
See application file for complete search history.

(56) References Cited

U.S. PATENT DOCUMENTS 10,046,452 B2 * 8/2018 Ikuta ..... B25F 5/001
2005/0262707 A1 12/2005 Wu
(Continued)

FOREIGN PATENT DOCUMENTS

CN 102528718 A 7/2012
CN 104440739 A 3/2015
(Continued)

OTHER PUBLICATIONS

May 25, 2021 Office Action issued in Chinese Patent Application No. 201980014004.6.
(Continued)

*Primary Examiner* — Daniel Jeremy Leeds
(74) *Attorney, Agent, or Firm* — Oliff PLC

(57) ABSTRACT

A work tool includes a housing, a spindle, a motor, a power-transmitting mechanism and a restricting member. The power-transmitting mechanism includes a sun member, a ring member, a carrier member and a planetary roller. One of the sun member and the ring member is configured to move together with the spindle in the front-rear direction relative to the other of the sun member and the ring member. The power-transmitting mechanism is configured to transmit power of the motor to the spindle when the sun member and the ring member relatively move toward each other in response to rearward movement of the spindle and the planetary roller gets into frictional contact with the sun member and the ring member. The restricting member is configured to restrict the planetary roller from moving in the front-rear direction relative to the housing.

19 Claims, 23 Drawing Sheets

(56) References Cited

U.S. PATENT DOCUMENTS

| | | | | |
|---|---|---|---|---|
| 2006/0086215 | A1* | 4/2006 | Furusawa | B25B 23/141 81/475 |
| 2012/0160530 | A1 | 6/2012 | Ikuta et al. | |
| 2012/0160535 | A1* | 6/2012 | Ikuta | B25B 21/00 173/176 |
| 2015/0075827 | A1 | 3/2015 | Ikuta | |
| 2016/0059401 | A1 | 3/2016 | Ikuta | |
| 2017/0129092 | A1* | 5/2017 | Kimura | B25B 21/00 |

FOREIGN PATENT DOCUMENTS

| | | | |
|---|---|---|---|
| JP | 2005-14145 | A | 1/2005 |
| JP | 2006-116657 | A | 5/2006 |
| JP | 2012-135842 | A | 7/2012 |
| JP | 2012-135843 | A | 7/2012 |
| JP | 2015-058518 | A | 3/2015 |
| JP | 2017-87362 | A | 5/2017 |

OTHER PUBLICATIONS

Oct. 5, 2021 Office Action issued in Japanese Patent Application No. 2018-027415.

Apr. 16, 2019 Search Report issued in International Patent Application No. PCT/JP2019/004494.

Aug. 27, 2020 International Preliminary Report on Patentability issued in International Patent Application No. PCT/JP2019/004494.

Dec. 22, 2021 Office Action issued in Chinese Patent Application No. 201980014004.6.

Mar. 1, 2022 Office Action issued in Japanese Patent Application No. 2019-001286.

Aug. 23, 2022 Office Action issued in Japanese Patent Application No. 2018-027415.

* cited by examiner

WORK TOOL

TECHNICAL FIELD

The present invention relates to a work tool that is configured to rotationally drive a tool accessory.

BACKGROUND

A work tool is known which is configured to rotationally drive a tool accessory coupled to a front end portion of a spindle and has a power-transmitting mechanism (clutch) for transmitting power of a motor to the spindle in response to push of the spindle. For example, Japanese laid-open patent publication No. 2012-135842 discloses a planetary-type power-transmitting mechanism that includes a fixed hub, a drive gear, planetary rollers, a retaining member for the planetary rollers. The fixed hub has a tapered surface on its outer periphery and is fixed to a housing. The cup-shaped drive gear has a tapered surface on its inner periphery and is rotatably held by the spindle. The planetary rollers are disposed between the tapered surfaces of the fixed hub and the drive gear. The retaining member for the planetary rollers is fixed to the spindle. When the drive gear is rotated by power of the motor and the spindle is pushed rearward, the planetary rollers get into frictional contact with the tapered surfaces of the fixed hub and the drive gear and revolve around an axis of the spindle while rotating. Thus, the retaining member for the planetary rollers rotates together with the spindle around the axis.

SUMMARY

Technical Problem

In the above-described power-transmitting mechanism, when the spindle is moved in an axial direction, the drive gear and the retaining member for the planetary rollers, which are held by the spindle, move toward or away from the fixed hub fixed to the housing. The planetary rollers are loosely disposed in grooves formed in the retaining member. With such a structure, the planetary rollers may move in the axial direction, which may result in causing unstable frictional contact between the planetary rollers and the tapered surfaces serving as drive surfaces.

Accordingly, it is an object of the present invention to provide improvement for establishing stable frictional contact between a planetary roller and drive surfaces, in a work tool including a planetary-roller-type power-transmitting mechanism which is configured to transmit power in response to rearward movement of a spindle.

Solution to Problem

According to one aspect of the present invention, a work tool is provided which is configured to rotationally drive a tool accessory. The work tool includes a housing, a spindle, a motor and a power-transmitting mechanism.

The spindle is supported by the housing so as to be movable along a specified driving axis extending in a front-rear direction of the work tool and rotatable around the driving axis. Further, the spindle has a front end portion configured such that the tool accessory is removably coupled thereto. The motor and the power-transmitting mechanism are housed in the housing. The power-transmitting mechanism includes a sun member, a ring member, a carrier member and a planetary roller. The sun member, the ring member and the carrier member are arranged coaxially with the driving axis. The planetary roller is rotatably retained by the carrier member. The sun member and the ring member have a first tapered surface and a second tapered surface, which are inclined relative to the driving axis, respectively. One of the sun member and the ring member is configured to move together with the spindle in the front-rear direction relative to the other of the sun member and the ring member. The planetary roller is at least partially disposed between the first tapered surface and the second tapered surface in a radial direction to the driving axis.

The power-transmitting mechanism is configured to transmit power of the motor to the spindle when the sun member and the ring member relatively move toward each other in response to rearward movement of the spindle and the planetary roller gets into frictional contact with the sun member and the ring member. Further, the power-transmitting mechanism is configured to interrupt transmission of the power when the sun member and the ring member relatively move away from each other in response to forward movement of the spindle and the planetary roller gets into non-frictional-contact with the sun member and the ring member. The work tool further includes a restricting member configured to restrict the planetary roller from moving in the front-rear direction relative to the housing. The manner of "restricting movement" herein is not limited to a manner of completely preventing movement and may include a manner of allowing slight movement.

The work tool of the present aspect includes a so-called planetary-roller-type power-transmitting mechanism. In this power-transmitting mechanism, the planetary roller is at least partially disposed between the first tapered surface of the sun member and the second tapered surface of the ring member in the radial direction to the driving axis of the spindle (a direction orthogonal to the driving axis). One of the sun member and the ring member can move together with the spindle in the front-rear direction relative to the other of the sun member and the ring member. On the other hand, the planetary roller is restricted from moving in the front-rear direction by the restricting member. This structure can reduce the possibility that the planetary roller moves in the front-rear direction along with relative movement of the sun member and the ring member, resulting in unstable frictional contact between the planetary roller and the first and second tapered surfaces.

In one aspect of the present invention, the carrier member may be held by the spindle so as to be movable in the front-rear direction relative to the spindle. In other words, the carrier member may be independent from the spindle in terms of movement in the front-rear direction. The carrier member may need to be positioned to retain the planetary roller such that the planetary roller does not come off from between the first tapered surface of the sun member and the second tapered surface of the ring member. According to the present aspect, regardless of movement of the spindle, the carrier member can be held in an appropriate position. Therefore, compared with a structure in which the carrier member moves together with the spindle, restrictions on an amount of movement of the spindle in the front-rear direction can be reduced. Particularly, when the planetary roller and/or the first and second tapered surfaces are worn, the spindle may need to be pushed up to a position where the sun member and the ring member are located closer to each other in order to establish stable frictional contact therebetween. Thus, the amount of movement of the spindle in the front-rear direction may need to be increased. According to the present aspect, such needs can also be appropriately met.

In one aspect of the present invention, the carrier member may be held to be non-rotatable around the driving axis relative to the spindle. Further, the carrier member may be configured to rotate together with the spindle by the power transmitted via the planetary roller. According to the present aspect, the rational planetary-roller-type power-transmitting mechanism can be realized having the carrier member serving as an output member.

In one aspect of the present invention, the restricting member may be configured to restrict the carrier member from moving in the front-rear direction relative to the housing. According to the present aspect, since the restricting member restricts the planetary roller and the carrier member from moving in the front-rear direction, an appropriate positional relationship between the planetary roller and the carrier member can be more reliably maintained.

In one aspect of the present invention, the restricting member may include a spring member that biases the spindle and the carrier member to move away from each other in the front-rear direction. Further, the spindle may be normally held in a foremost position by biasing force of the spring member. According to the present aspect, when the push of the spindle is released, the spindle can be returned to the foremost position (i.e. initial position) while movement of the carrier member is restricted by the biasing force of the spring member.

In one aspect of the present invention, the ring member may be supported by the spindle so as to be movable in the front-rear direction together with the spindle and rotatable around the driving axis. The spring member may be disposed between the carrier member and the ring member in the front-rear direction. The work tool may further include a receiving member that receives one end of the spring member on the ring member side while the spring member is isolated from rotation of the ring member. According to the present aspect, rotation (so-called corotation) of the spring member together with the ring member and heat generation of a sliding portion between the spring member and the ring member can be prevented.

In one aspect of the present invention, the ring member may be configured to be rotated by the power of the motor. Further, the spring member may be configured to bias the ring member and the carrier member respectively forward and rearward to move away from each other. In other words, the spring member may also have a function of biasing the ring member and the carrier member, which respectively serve as a driving-side member and a driven-side member in the power-transmitting mechanism, in directions to interrupt power transmission. According to the present aspect, a plurality of functions of restricting movement of the carrier member in the front-rear direction and interrupting power transmission can be realized by the spring member without increasing the number of parts.

In one aspect of the present invention, the ring member may have at least one communication hole that provides communication between an inside and an outside of the ring member. According to the present aspect, an air flow can be generated through the communication hole by centrifugal force generated by driving of the power-transmitting mechanism (typically, rotation of the ring member). This can realize suppression of local temperature rise in the power-transmitting mechanism, and smoother circulation of lubricants provided in the housing. As a result, wear of the planetary roller and/or the first and second tapered surfaces can be effectively reduced, so that durability can be improved.

In one aspect of the present invention, the communication hole may be formed in a region of the ring member that is different from a region corresponding to the second tapered surface. According to the present aspect, the communication hole can be easily formed in the ring member.

DESCRIPTION OF EMBODIMENTS

Embodiments of the present invention are now described with reference to the drawings.

First Embodiment

A screwdriver 1 according to a first embodiment is described with reference to FIGS. 1 to 14. The screwdriver 1 is an example of a work tool which is configured to rotationally drive a tool accessory. More specifically, the screwdriver 1 is an example of a screw-tightening tool which is capable of performing a screw-tightening operation and a screw-loosening operation by rotationally driving a driver bit 9 coupled to a spindle 3.

Figure 1:
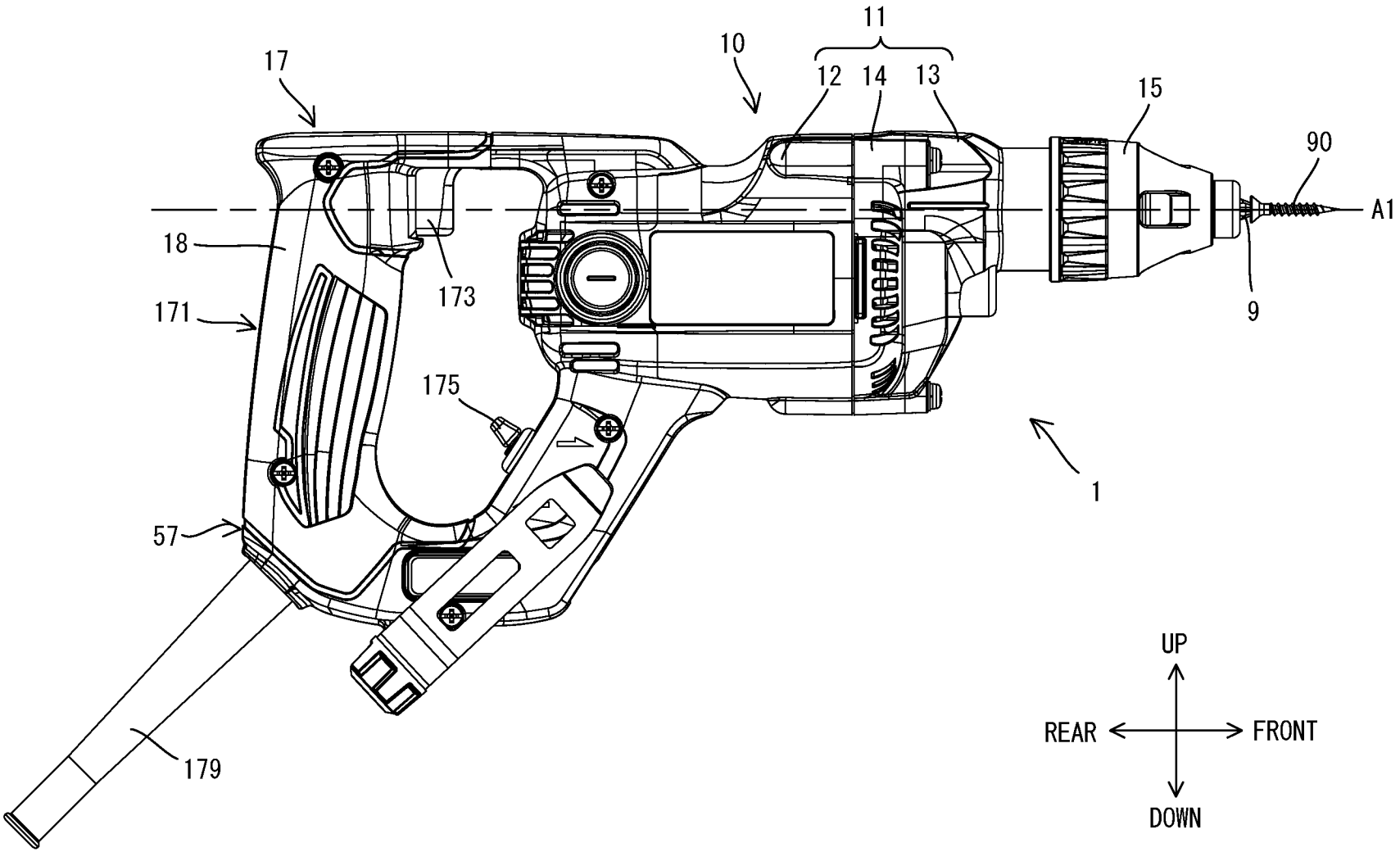
FIG. 1 is a side view of a screwdriver according to a first embodiment.
Figure 2:
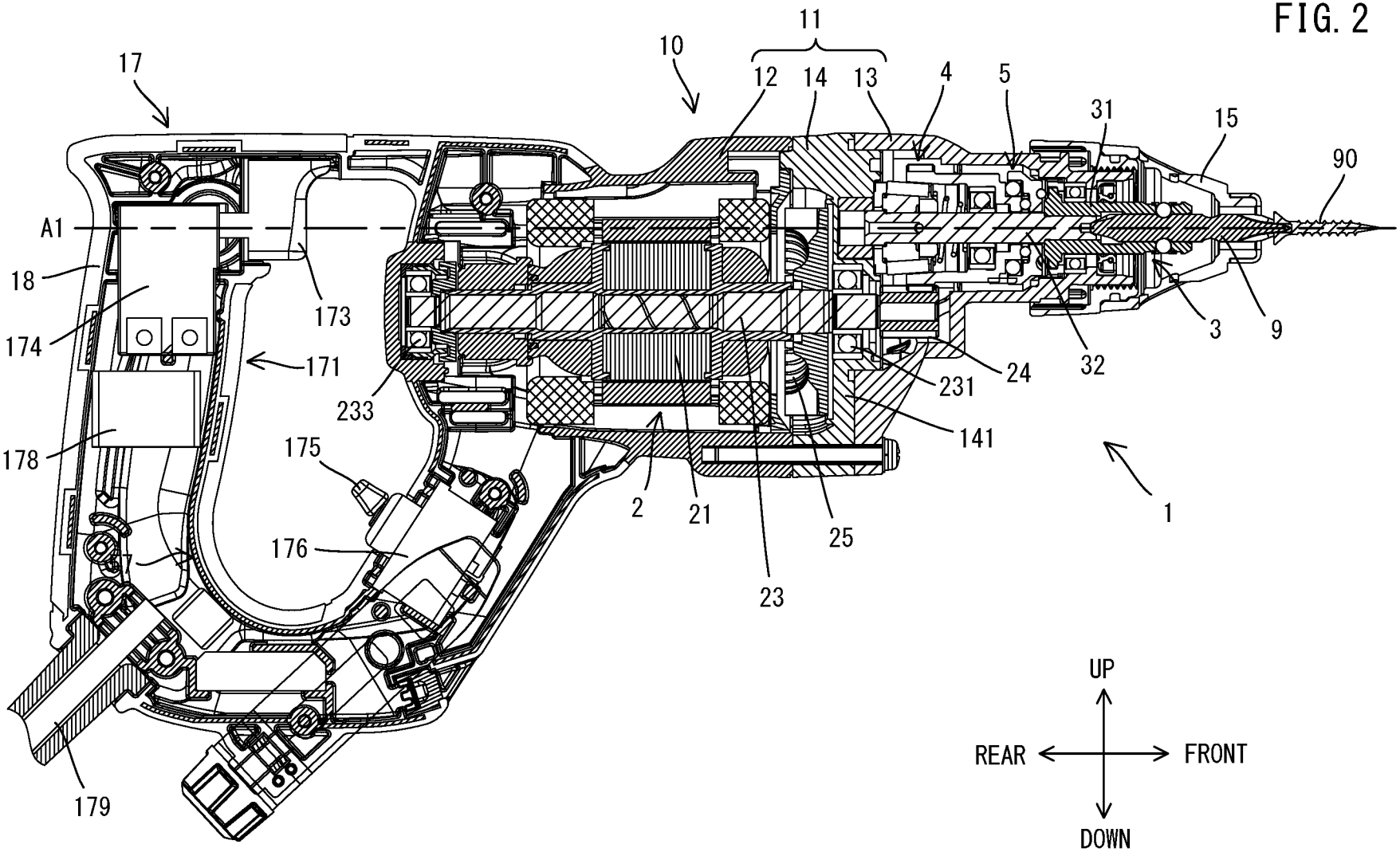
FIG. 2 is a longitudinal section view of the screwdriver.

First, the general structure of the screwdriver 1 is described. As shown in FIGS. 1 and 2, the screwdriver 1 has a body 10 including a motor 2 and the spindle 3, and a handle 17 including a grip part 171. The body 10 has an elongate shape as a whole, extending along a specified driving axis A1. The driver bit 9 may be removably coupled to one end portion of the body 10 in a longitudinal direction (an extending direction of the driving axis A1). The handle 17 is C-shaped as a whole and connected to the other end portion of the body 10 in the longitudinal direction so as to form a loop shape. A portion of the handle 17 which is spaced apart from the body 10 and linearly extends in a direction generally orthogonal to the driving axis A1 forms the grip part 171 to be held by a user. One end portion in a longitudinal direction of the grip part 171 is located on the driving axis A1. A trigger 173 to be depressed by a user is provided in this end portion. Further, a power cable 179 that is connectable to an external alternate current (AC) power source is connected to the other end portion of the grip part 171.

In the screwdriver 1 of the present embodiment, when the trigger 173 is depressed by a user, the motor 2 is driven. Further, when the spindle 3 is pushed rearward, power of the motor 2 is transmitted to the spindle 3 and the driver bit 9 is rotationally driven. In this manner, a screw-tightening operation or a screw-loosening operation is performed.

The detailed structure of the screwdriver 1 is now described. In the following description, for convenience sake, the extending direction (axial direction) of the driving axis A1 is defined as a front-rear direction of the screwdriver 1. In the front-rear direction, the side to which the driver bit 9 may be removably coupled is defined as a front side, and the side on which the grip part 171 is arranged is defined as a rear side. A direction which is orthogonal to the driving axis A1 and which corresponds to the extending direction of the grip part 171 is defined as an up-down direction. In the up-down direction, the side on which the trigger 173 is arranged is defined as an upper side and the side to which the power cable 179 is connected is defined as a lower side. A direction which is orthogonal to the front-rear direction and the up-down direction is defined as a left-right direction.

The body 10 and the handle 17 are now briefly described. As shown in FIG. 2, an outer shell of the body 10 is mainly formed by a body housing 11. The body housing 11 includes a cylindrical rear housing 12 that houses the motor 2, a cylindrical front housing 13 that houses the spindle 3, and a central housing 14 disposed between the rear housing 12 and the front housing 13. A front end portion of the central housing 14 has a partition wall 141 arranged generally orthogonally to the driving axis A1. The central housing 14 and the front housing 13 are fixed to the rear housing 12 by screws, so that the three housings are integrated together as the body housing 11. The detailed structure of the body 10, including its internal structure, will be described later.

A cylindrical locator 15 is removably coupled onto a front end portion of the front housing 13. The locator 15 can be moved in the front-rear direction relative to the front housing 13 and may be fixed to any position by a user. In this manner, a screwing depth, that is, an amount of protrusion of the driver bit 9 from the locator 15 may be set.

As shown in FIG. 2, an outer shell of the handle 17 is mainly formed by a handle housing 18. The handle housing 18 is formed by right and left halves. The left half is integrally formed with the rear housing 12. The handle housing 18 houses a main switch 174, a rotation-direction switch 176 and a controller 178.

The main switch 174 is a switch for starting the motor 2 and is disposed within the grip part 171 behind the trigger 173. The main switch 174 is normally kept in an OFF state and switched to an ON state when the trigger 173 is depressed. The main switch 174 outputs a signal indicating the ON state or OFF state to the controller 178 via a wiring (not shown).

A switching lever 175 for switching a rotation direction of the driver bit 9 (specifically, a rotation direction of a motor shaft 23) is provided in a portion of the handle housing 18 which connects a lower end portion of the grip part 171 and a lower rear end portion of the body 10 (the rear housing 12). By operating the switching lever 175, a user can set the rotation direction of the motor shaft 23 to either one of a direction (a normal direction or a screw-tightening direction) in which the driver bit 9 tightens a screw 90 and a direction (a reverse direction or a screw-loosening direction) in which the driver bit 9 loosens the screw 90. The rotation-direction switch 176 outputs a signal corresponding to the rotation direction set via the switching lever 175, to the controller 178 via a wiring (not shown).

The controller 178 including a control circuit is disposed below the main switch 174. The controller 178 is configured to drive the motor 2 according to the rotation direction indicated by the signal from the rotation-direction switch 176 when the signal from the main switch 174 indicates the ON state.

The detailed structure of the body 10 including the internal structure is now described.

As shown in FIG. 2, the rear housing 12 houses the motor 2. In the present embodiment, an AC motor is employed as the motor 2. The motor shaft 23 extends from a rotor 21 of the motor 2 in parallel to the driving axis A1 (in the front-rear direction) below the driving axis A1. The motor shaft 23 is rotatably supported at its front and rear end portions by bearings 231, 233. The front bearing 231 is supported by the partition wall 141 of the central housing 14, and the rear bearing 233 is supported by a rear end portion of the rear housing 12. Further, a fan 25 for cooling the motor 2 is fixed to a portion of the motor shaft 23 in front of the rotor 21 and housed within the central housing 14. A front end portion of the motor shaft 23 protrudes into the front housing 13 through a through hole of the partition wall 141. A pinion gear 24 is formed on the front end portion of the motor shaft 23.

Figure 3:
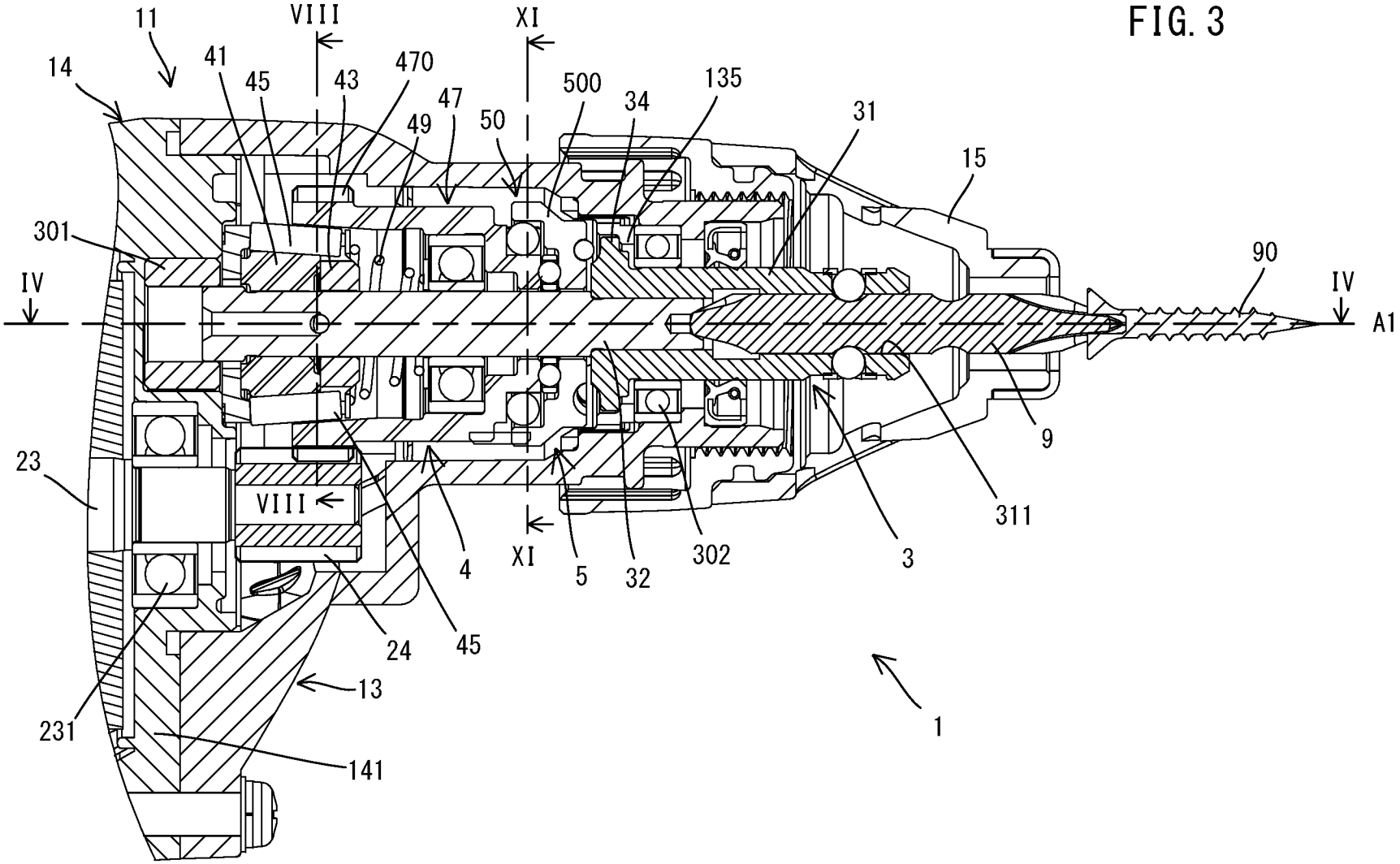
FIG. 3 is a partial, enlarged view of FIG. 2.
Figure 4:
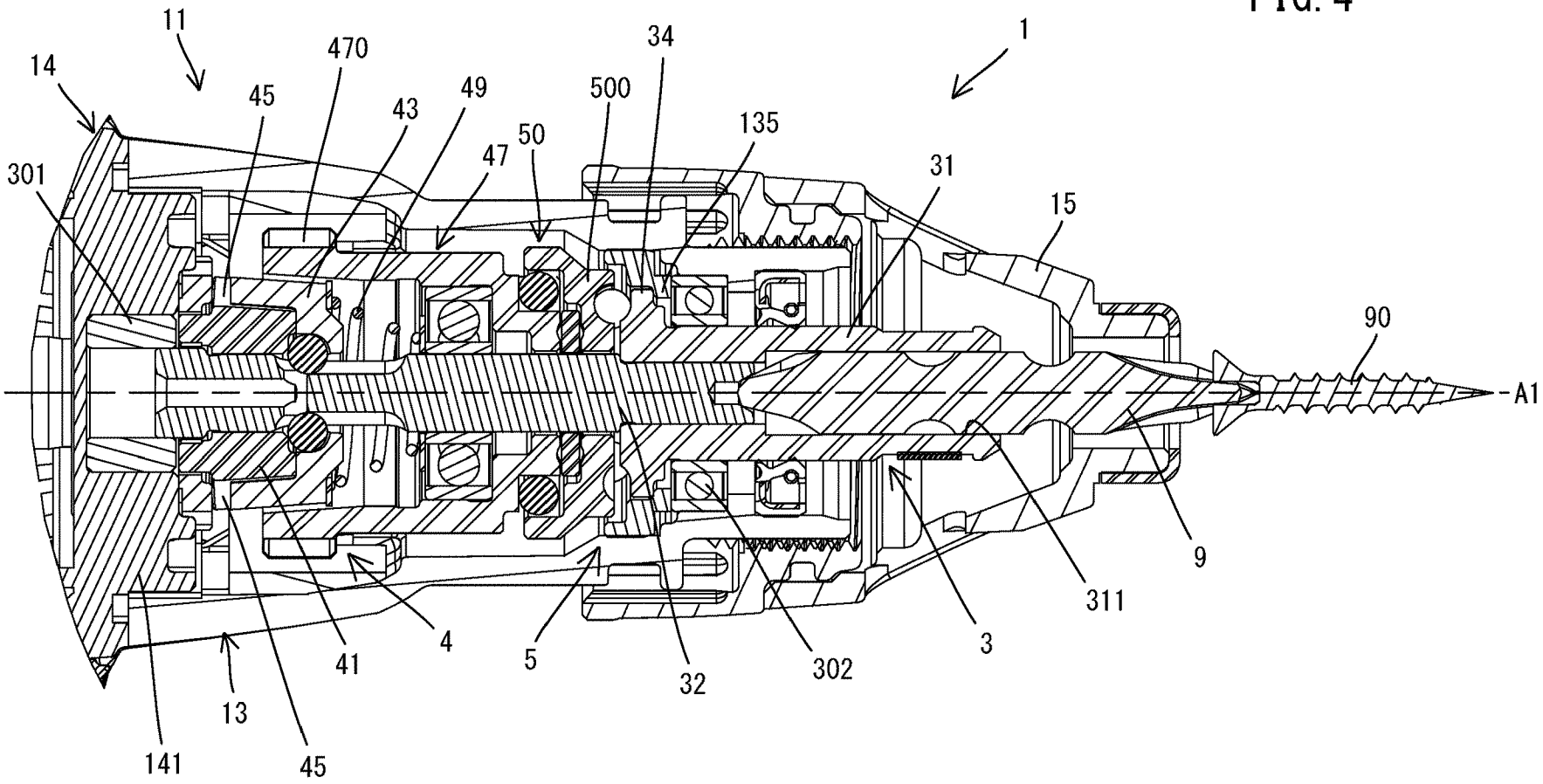
FIG. 4 is a sectional view taken along line IV-IV in FIG. 3.

As shown in FIGS. 3 and 4, the front housing 13 houses the spindle 3, a power-transmitting mechanism 4 and a position-switching mechanism 5, of which detailed structures are now described in this order.

As shown in FIGS. 3 and 4, the spindle 3 is a generally circular cylindrical elongate member, and extends in the front-rear direction along the driving axis A1. In the present embodiment, a front shaft 31 and a rear shaft 32 which are separately formed are fixedly connected and integrated together to form the spindle 3. However, the spindle 3 may be formed by only a single shaft. The spindle 3 has a flange 34 protruding radially outward on its central portion in the front-rear direction (specifically, a rear end portion of the front shaft 31).

The spindle 3 is supported by a bearing (specifically, an oilless bearing) 301 and a bearing (specifically, a ball bearing) 302 so as to be rotatable around the driving axis A1 and movable along the driving axis A1 in the front-rear direction. The bearing 301 is supported by the partition wall 141 of the central housing 14. The bearing 302 is supported by a front end portion of the front housing 13. The spindle 3 is normally biased forward by a biasing force of a biasing spring 49, which will be described later, and held in a position where a front end surface of the flange 34 gets into contact with a stopper part 135 provided within the front housing 13. The position of the spindle 3 at this time is a foremost position (also referred to as an initial position) within a movable range of the spindle 3. Further, a front end portion of the spindle 3 (the front shaft 31) protrudes from the front housing 13 into the locator 15. A bit-insertion hole 311 is formed along the driving axis A1 in the front end portion of the spindle 3 (the front shaft 31). Steel balls biased by a flat spring may be engaged with a small-diameter portion of the driver bit 9 inserted into the bit-insertion hole 311, so that the driver bit 9 is removably held.

The power-transmitting mechanism 4 is now described. As shown in FIGS. 3 and 4, the power-transmitting mechanism 4 of the present embodiment is mainly formed by a planetary mechanism including a tapered sleeve 41, a retainer 43, a plurality of rollers 45 and a gear sleeve 47. The tapered sleeve 41, the retainer 43 and the gear sleeve 47 are arranged coaxially with the spindle 3 (with the driving axis A1). The tapered sleeve 41, the retainer 43, the rollers 45 and the gear sleeve 47 correspond to a sun member, a carrier member, planetary members and a ring member of the planetary mechanism, respectively. In the present embodiment, the power-transmitting mechanism 4 is configured as a so-called solar-type planetary speed-reducing mechanism, in which the tapered sleeve 41 serving as the sun member is fixed, the gear sleeve 47 serving as the ring member operates as an input member, and the retainer 43 serving as the carrier member operates as an output member. Therefore, the gear sleeve 47 and the retainer 43 (the spindle 3) rotate in the same direction.

The power-transmitting mechanism 4 is configured to transmit power of the motor 2 to the spindle 3 and to interrupt the power transmission. Specifically, the power-transmitting mechanism 4 is configured such that when the gear sleeve 47 moves toward or away from the tapered sleeve 41, the retainer 43 and the rollers 45 in the front-rear direction, the rollers 45 get into frictional contact or non-frictional-contact with the tapered sleeve 41 and the gear sleeve 47. Thus, the power-transmitting mechanism 4 may be switched between a transmission state in which power of the motor 2 can be transmitted to the spindle 3 and an interruption state in which power of the motor 2 cannot be transmitted to the spindle 3. Thus, the power-transmitting mechanism 4 of the present embodiment can be referred to as a planetary-roller-type friction clutch mechanism.

The detailed structure and the arrangement of each of the components of the power-transmitting mechanism 4 are now described.

Figure 5:
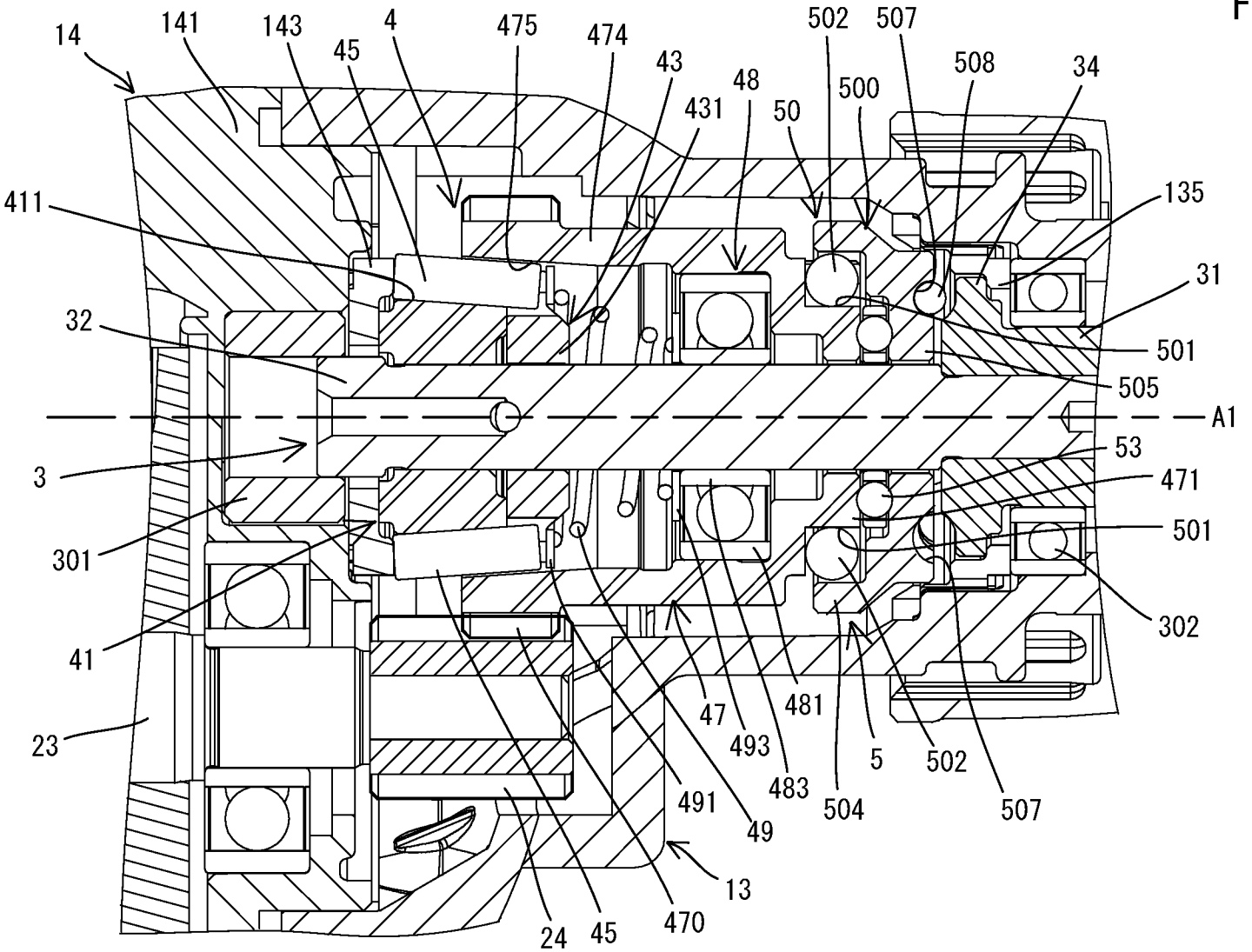
FIG. 5 is a partial, enlarged view of FIG. 3.
Figure 6:
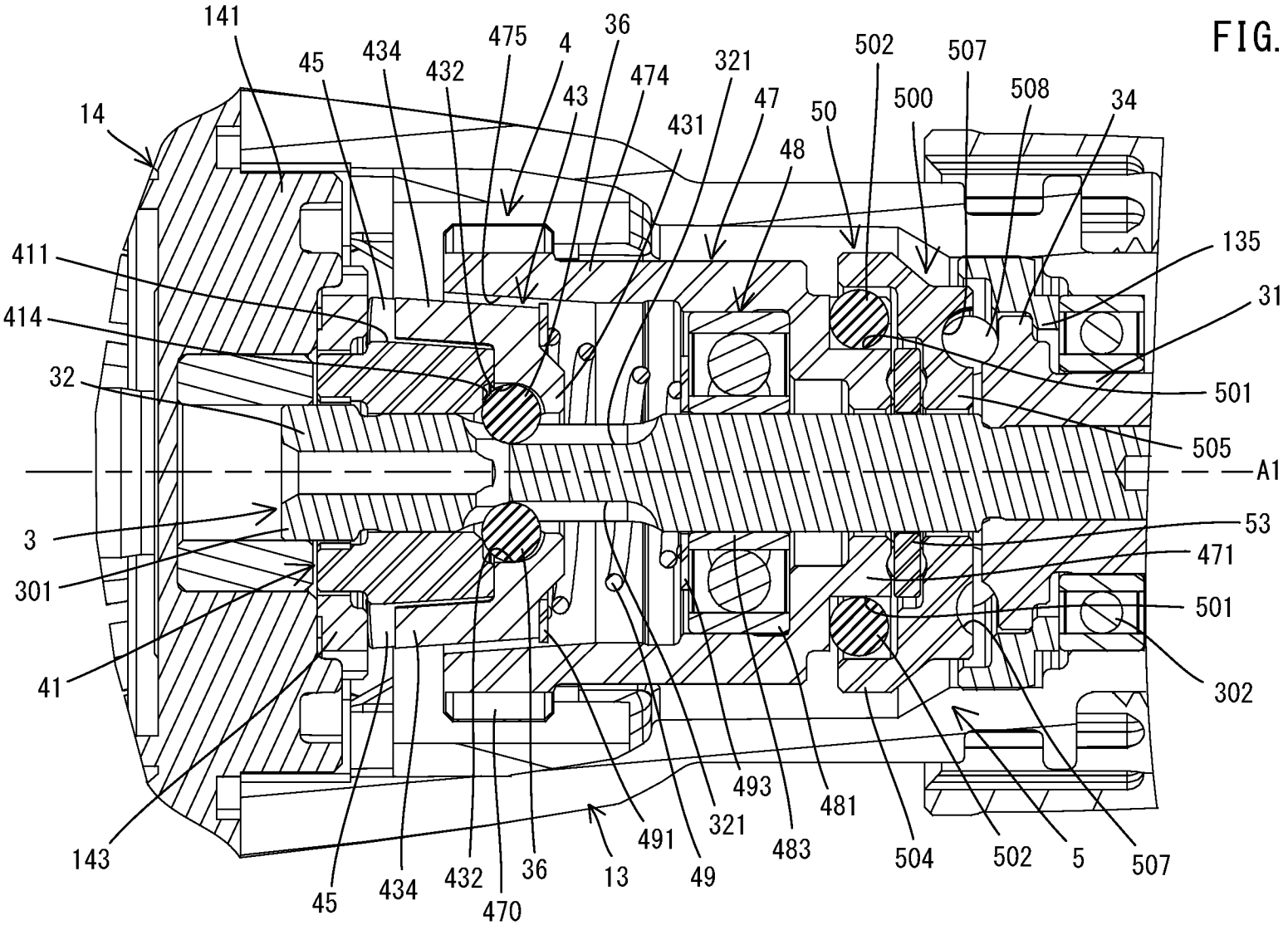
FIG. 6 is a partial, enlarged view of FIG. 4.
Figure 7:
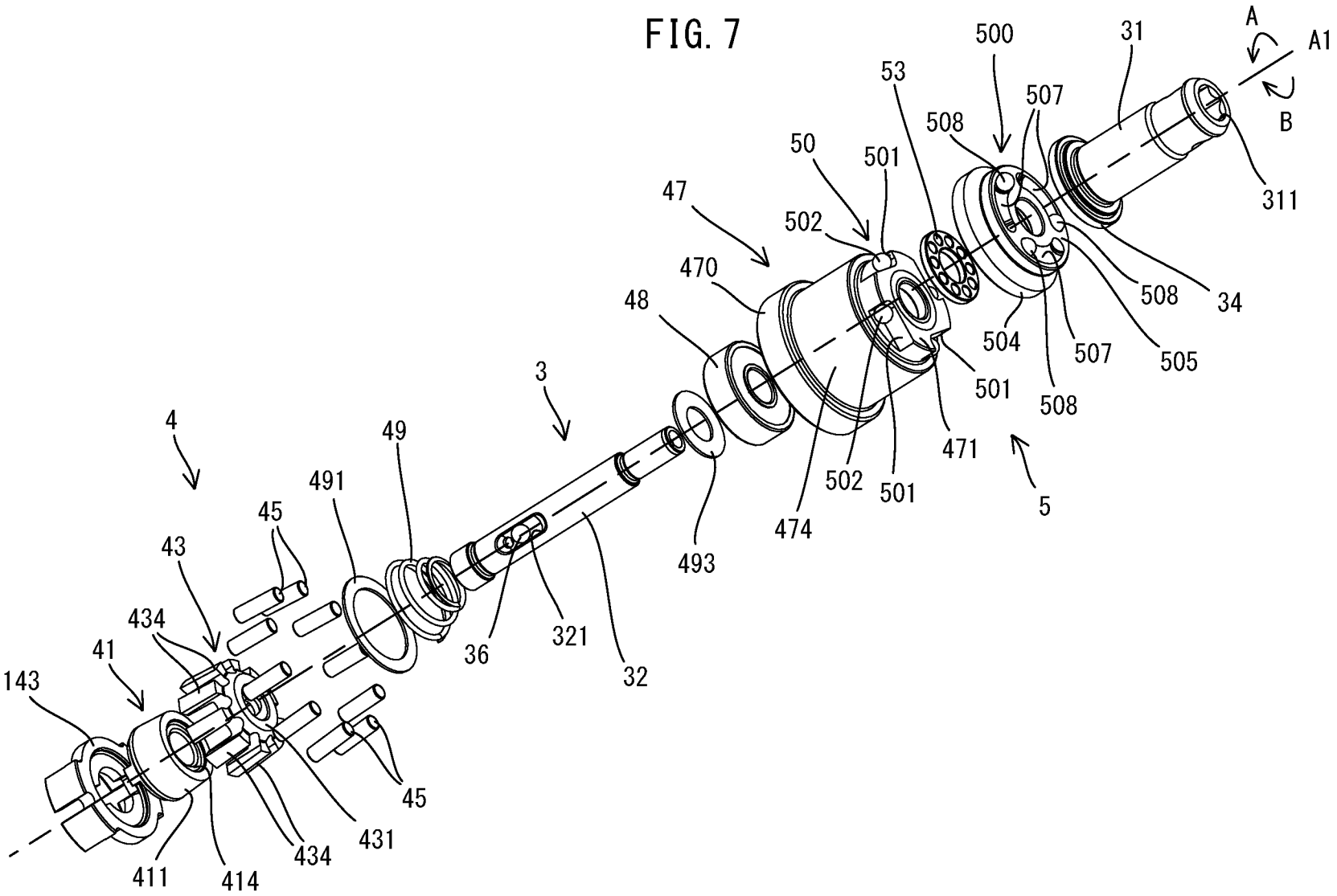
FIG. 7 is an exploded perspective view showing a spindle, a power-transmitting mechanism and a position-switching mechanism.

First, the tapered sleeve 41 is described. As shown in FIGS. 5 to 7, the tapered sleeve 41, which corresponds to the sun member, is configured as a cylindrical member. The tapered sleeve 41 is fixed to the body housing 11 (specifically, the partition wall 141) via a base 143 so as to be non-rotatable around the driving axis A1. The base 143 is fixed to the partition wall 141 and integrated with the body housing 11 in front of the bearing 301 which supports the rear end portion of the spindle 3 (the rear shaft 32). The spindle 3 (specifically, the rear shaft 32) is loosely inserted through the tapered sleeve 41 so as to be movable in the front-rear direction and rotatable relative to the tapered sleeve 41.

An outer peripheral surface of the tapered sleeve 41 is configured as a tapered surface 411 inclined at a specified angle relative to the driving axis A1. More specifically, the tapered sleeve 41 has a truncated conical outer shape which is tapered forward (having a diameter decreasing toward the front). The tapered surface 411 is configured as a conical surface which is inclined forward in a direction toward the driving axis A1. Further, in the present embodiment, an inclination angle of the tapered surface 411 relative to the driving axis A1 is set to approximately 4 degrees (approximately 8 degrees when viewed in a cross section of the cone shape of the tapered sleeve).

Next, the retainer 43 is described. The retainer 43 serving as the carrier member is a member that retains the rollers 45 serving as the planetary members to be rotatable. As shown in FIGS. 5 to 7, the retainer 43 has a generally circular bottom wall 431 having a through hole and a plurality of retaining arms 434 protruding from an outer edge of the bottom wall 431. The retaining arms 434 are arranged apart from each other in a circumferential direction. In the present embodiment, the retainer 43 has ten retaining arms 434, but the number of the retaining arms 434 (and the number of the rollers 45) may be appropriately changed. The retainer 43 is arranged with the bottom wall 431 on the front side (such that the retaining arms 434 protrude rearward). The retainer 43 is supported by the spindle 3 so as to be non-rotatable and movable in the front-rear direction relative to the spindle 3, in a state in which the retaining arms 434 are partially overlapped with the tapered sleeve 41 in the radial direction. Each of the retaining arms 434 protrudes rearward from the outer edge of the bottom wall 431 at the same inclination angle as the tapered surface 411 of the tapered sleeve 41 relative to the driving axis A1 (in other words, in parallel to the tapered surface 411).

As shown in FIGS. 6 and 7, a pair of grooves 321 are formed across the driving axis A1 in a front portion of a rear end portion of the rear shaft 32 of the spindle 3. Each of the grooves 321 has a U-shaped cross section and extends linearly in the front-rear direction. A steel ball 36 is rollably disposed in each of the grooves 321. Further, a pair of recesses 432 are formed across the driving axis A1 in a rear surface (a surface on the retaining arm 434 side) of the bottom wall 431 of the retainer 43. A portion of the ball 36 disposed within the groove 321 is engaged with the recess 432. Furthermore, an annular recess 414 is formed in the center of a front end surface of the tapered sleeve 41. The retainer 43 is biased rearward by the biasing spring 49 and held in a state in which the balls 36 are each arranged within a space defined by the recesses 414, 432 and a rear surface of the bottom wall 431 is in contact with the front end surface of the tapered sleeve 41, which will be described in detail later. Further, rear ends of the retaining arms 434 are arranged apart forward from the base 143.

With such a structure, the retainer 43 is engaged with the spindle 3 via the balls 36 in the radial direction and the circumferential direction of the spindle 3 so as to be rotatable together with the spindle 3. Further, the balls 36 can roll within the annular recess 414 of the tapered sleeve 41, and the retainer 43 can rotate around the driving axis A1 together with the spindle 3 relative to the tapered sleeve 41. The spindle 3 can move in the front-rear direction relative to the retainer 43 within the range in which the balls 36 can roll within the respective grooves 321.

Figure 8:
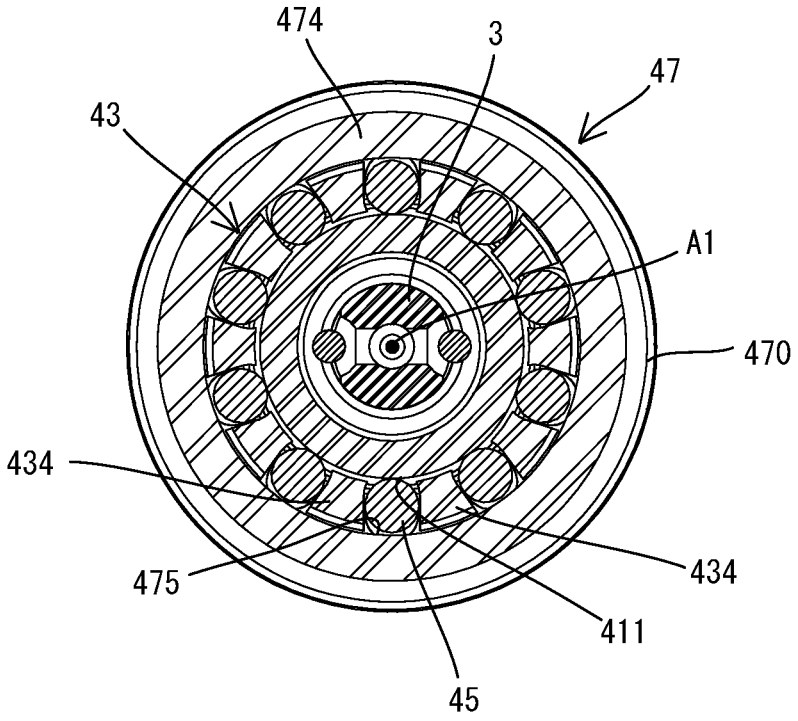
FIG. 8 is a sectional view taken along line VIII-VIII in FIG. 3, for illustrating a state of non-frictional-contact of rollers with a tapered sleeve and a gear sleeve.

As shown in FIGS. 5 to 7, each of the rollers 45, which corresponds to the planetary member, is a circular columnar member. In the present embodiment, the roller 45 has a constant diameter and is retained between the adjacent retaining arms 434 so as to be rotatable around a rotation axis extending generally in parallel to the tapered surface 411. The length of the roller 45 is set to be longer than that of the retaining arms 434. Further, as shown in FIG. 8, a portion of an outer peripheral surface of the roller 45 retained by the retaining arms 434 slightly protrudes from inner and outer surfaces of the retaining arms 434 in the radial direction of the retainer 43.

Next, the gear sleeve 47 is described. As shown in FIGS. 5 to 7, the gear sleeve 47, which corresponds to the ring member, is configured as a generally cup-shaped member having an inner diameter larger than the outer diameters of the tapered sleeve 41 and the retainer 43.

The gear sleeve 47 has a bottom wall 471 having a through hole and a cylindrical peripheral wall 474 contiguous to the bottom wall 471. An outer ring 481 of a bearing (specifically, a ball bearing) 48 is fixed to a portion of an inner peripheral surface of the peripheral wall 474 in the vicinity of the bottom wall 471. The gear sleeve 47 is arranged with the bottom wall 471 on the front side (to be open to the rear). The gear sleeve 47 is supported by the spindle 3 in front of the retainer 43 so as to be rotatable and movable in the front-rear direction relative to the spindle 3. More specifically, the rear shaft 32 of the spindle 3 is loosely inserted through the through hole of the bottom wall 471 and inserted through an inner ring 483 of the bearing 48 so as to be slidable in the front-rear direction. Thus, a cylindrical internal space is formed between the spindle 3 and the peripheral wall 474 behind the bearing 48. Portions of the tapered sleeve 41, the retainer 43 and the rollers 45, as well as the biasing spring 49 to be described below are disposed in this internal space. Further, gear teeth 470, which are always engaged with the pinion gear 24, are integrally formed on an outer periphery of the gear sleeve 47 (specifically, the peripheral wall 474). Thus, the gear sleeve 47 is rotationally driven along with rotation of the motor shaft 23.

A portion of an inner peripheral surface of the peripheral wall 474 of the gear sleeve 47 which extends rearward of the bearing 48 (on the open end side) includes a tapered surface 475 which is inclined relative to the driving axis A1, at the same angle as the tapered surface 411 of the tapered sleeve 41 (in other words, extends in parallel to the tapered surface 411). Specifically, the tapered surface 475 is configured as a conical surface which is inclined rearward (toward the open end of the gear sleeve 47) in a direction away from the driving axis A1. Each of the rollers 45 is retained by the retainer 43 such that at least a portion (specifically, a front portion) of the roller 45 is located between the tapered surface 411 and the tapered surface 475 in the radial direction of the spindle 3 (in the direction orthogonal to the driving axis A1).

In the present embodiment, the power-transmitting mechanism 4 includes the biasing spring 49 which is disposed between the gear sleeve 47 and the retainer 43 (and the rollers 45) in the front-rear direction. In the present embodiment, the biasing spring 49 is configured as a conical coil spring and arranged such that one larger-diameter side end is disposed on the rear side and the other smaller-diameter side end is disposed on the front side. More specifically, the larger-diameter side end of the biasing spring 49 is held in contact with a large-diameter washer 491 and the smaller-diameter side end is held in contact with a small-diameter washer 493. The washer 491 is arranged in contact with a front end surface of the retaining arms 434 of the retainer 43. The washer 493 is arranged in contact with the inner ring 483 of the bearing 48 mounted within the gear sleeve 47, but not in contact with the outer ring 481. Thus, the biasing spring 49 can rotate together with the retainer 43, but is isolated from rotation of the gear sleeve 47.

The biasing spring 49 always biases the retainer 43 and the gear sleeve 47 via the washers 491, 493 in directions away from each other, that is, respectively in rearward and forward directions. Thus, the retainer 43 is held in a position where the rear surface of the bottom wall 431 is in contact with the front end surface of the tapered sleeve 41 by the biasing force of the biasing spring 49, and thus restricted from moving in the front-rear direction. Further, the rollers 45 are held between the washer 491 and the front end surface of the base 143 fixed to the body housing 11 and thus restricted from moving in the front-rear direction. The manner of "being restricted from moving" herein does not mean the manner of being completely prevented from moving, and slight movement may be allowed. In the present embodiment, the distance between the washer 491 and the front end surface of the base 143 is set to be slightly longer than the length of the rollers 45 (in other words, a play is provided), and the rollers 45 are allowed to move by the amount of the play. Further, the biasing spring 49 may be held in direct contact with the retainer 43 and the inner ring 483 without the washers 491, 493 interposed therebetween.

Further, when the gear sleeve 47 is biased forward by the biasing force of the biasing spring 49, the spindle 3 is also biased forward via a thrust bearing 53, a lead sleeve 500 and balls 508, which will be described later, and held in the initial position where the flange 34 is in contact with the stopper part 135.

Figure 9:
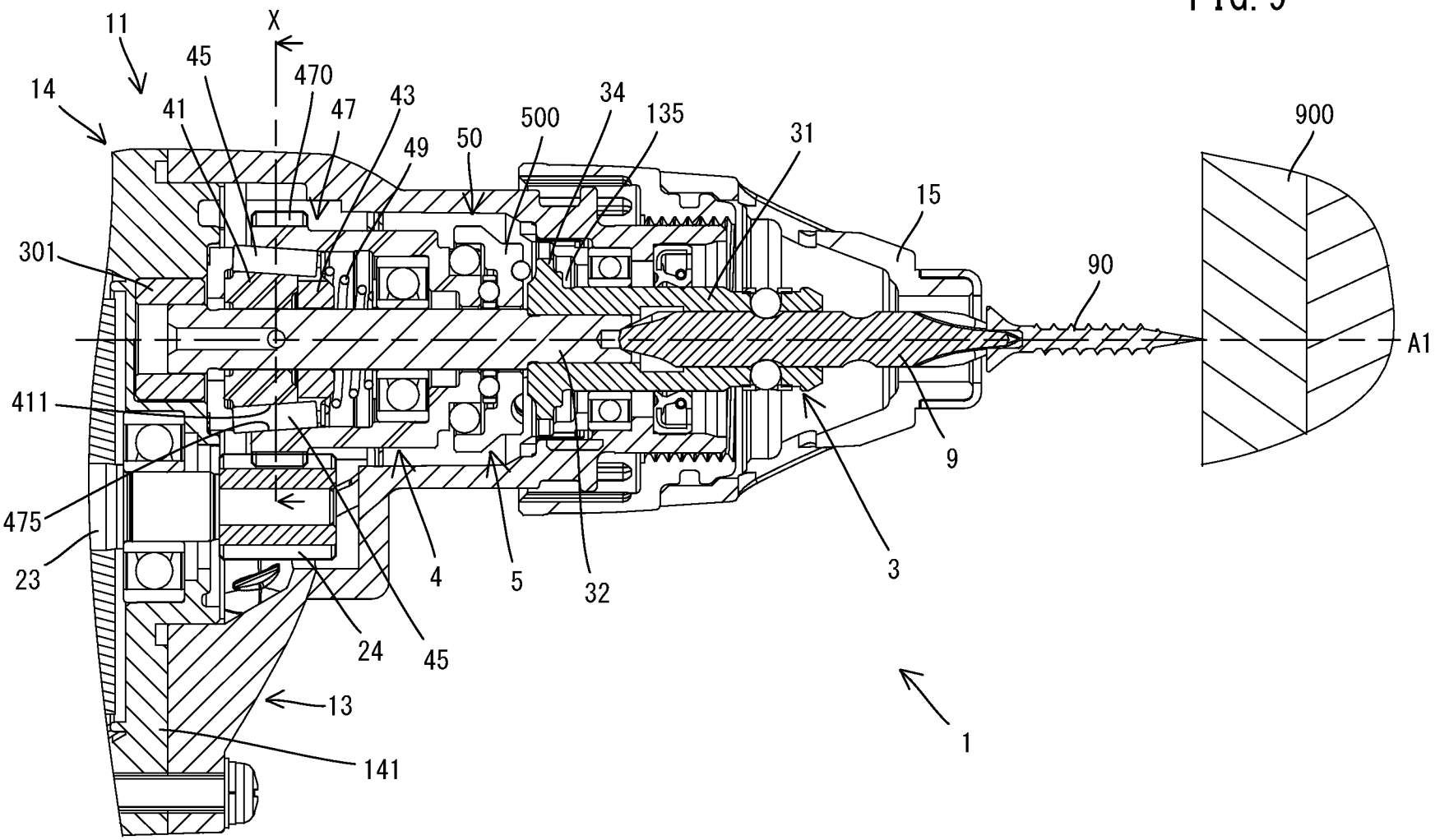
FIG. 9 is a longitudinal section view showing the screwdriver when the spindle is moved rearward from an initial position and the power-transmitting mechanism is turned to a transmission state.
Figure 10:
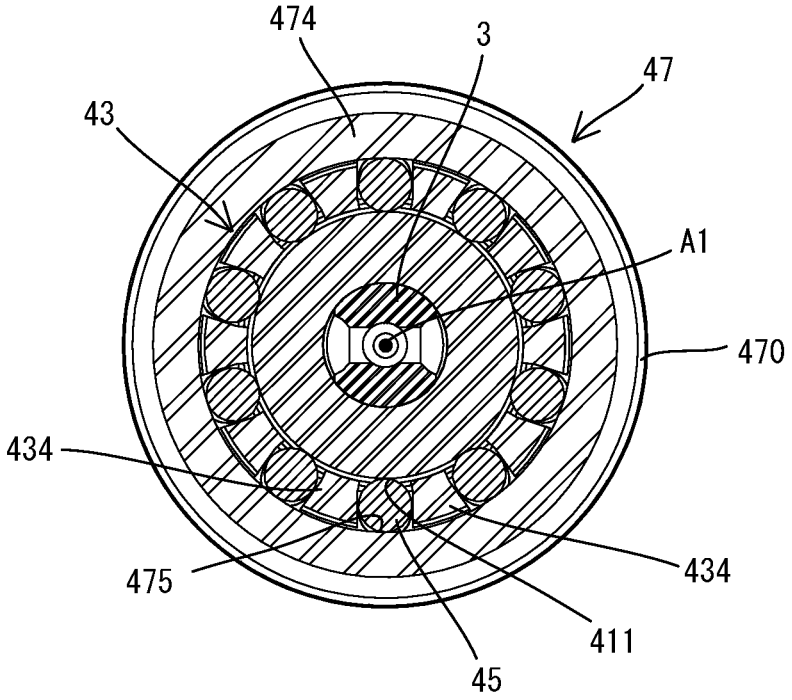
FIG. 10 is a sectional view taken along line X-X in FIG. 9, for illustrating a state of frictional contact of the rollers with the tapered sleeve and the gear sleeve.

When the spindle 3 is located in the initial position, as shown in FIGS. 5 and 8, the rollers 45 are loosely disposed (more specifically, apart from the tapered surface 475) between the tapered surface 411 of the tapered sleeve 41 and the tapered surface 475 of the gear sleeve 47, and held in non-frictional-contact with the tapered sleeve 41 and the gear sleeve 47. Thus, the power-transmitting mechanism 4 is in the interruption state. On the other hand, as shown in FIG. 9, when the gear sleeve 47 moves rearward relative to the body housing 11 (toward the tapered sleeve 41, the retainer 43 and the rollers 45) and the distance between the tapered surface 411 of the tapered sleeve 41 and the tapered surface 475 of the gear sleeve 47 is narrowed, as shown in FIG. 10, the rollers 45 are held between the tapered surface 411 and the tapered surface 475 and thus placed in frictional contact with the tapered sleeve 41 and the gear sleeve 47. Thus, the power-transmitting mechanism 4 is shifted to the transmission state. Operation of the power-transmitting mechanism 4 will be described in detail later.

The position-switching mechanism 5 is now described. The position-switching mechanism 5 is a mechanism that relatively moves the gear sleeve 47 and the front end portion of the spindle 3 in directions away from each other in the front-rear direction when the gear sleeve 47 is rotationally driven in the reverse direction (screw-loosening direction). By provision of such a structure, when the gear sleeve 47 is rotationally driven in the reverse direction (screw-loosening direction) in a state in which the spindle 3 is located in the initial position, the position-switching mechanism 5 moves the gear sleeve 47 rearward toward the retainer 43 and the rollers 45, relative to the spindle 3. The position-switching mechanism 5 is now described in detail.

As shown in FIGS. 5 to 7, in the present embodiment, the position-switching mechanism 5 mainly includes a one-way clutch 50, the lead sleeve 500 having lead grooves 507, and the balls 508.

In the present embodiment, the one-way clutch 50 includes cam grooves 501 formed in the front end portion of the gear sleeve 47 and balls 502. The one-way clutch 50 is configured to rotate the lead sleeve 500 together with the gear sleeve 47 only when the gear sleeve 47 is rotationally driven in the reverse direction.

Figure 11:
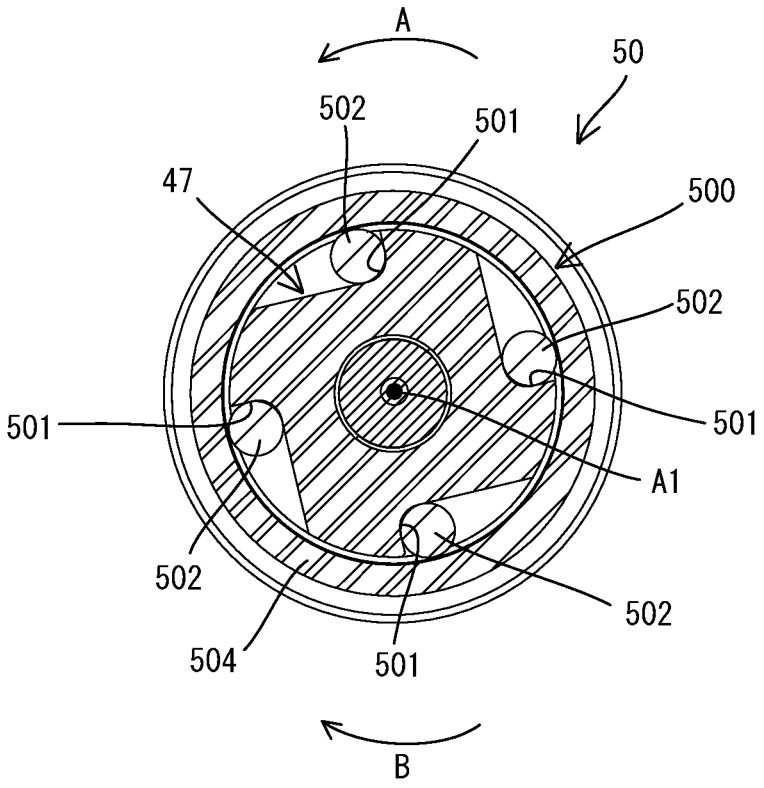
FIG. 11 is a sectional view taken along line XI-XI in FIG. 3, for illustrating a state of a one-way clutch when the gear sleeve is rotationally driven in a normal direction.

As shown in FIGS. 7 and 11, each of the cam grooves 501 is formed to be recessed inward in the radial direction of the gear sleeve 47 from the outer peripheral surface of the peripheral wall 474 of the front end portion of the gear sleeve 47. The depth of the cam groove 501 from its outer peripheral surface in the radial direction decreases from an upstream side toward a downstream side in the normal direction (screw-tightening direction) of the gear sleeve 47 which is shown by arrow A in the drawings (increases from an upstream side toward a downstream side in the reverse direction (screw-loosening direction) of the gear sleeve 47 which is shown by arrow B in the drawings). In the present embodiment, four cam grooves 501 are provided to be equidistantly spaced apart in the circumferential direction around the driving axis A1. The steel balls 502 are respectively disposed in the cam grooves 501. Further, as shown in FIG. 11, the diameter of each of the balls 502 is set to be slightly larger than the depth of a deepest portion (specifically, an upstream end portion in the normal direction) of the cam groove 501.

As shown in FIGS. 5 to 7, the lead sleeve 500 is formed as a generally cup-shaped member and includes a bottom wall 505 having a through hole and a cylindrical peripheral wall 504 protruding from an outer edge of the bottom wall 505. The lead sleeve 500 is disposed between the gear sleeve 47 and the flange 34 of the spindle 3 in a state in which the bottom wall 505 is disposed on the front side and the rear shaft 32 of the spindle 3 is loosely inserted through the through hole of the bottom wall 505. The thrust bearing (specifically, thrust ball bearing) 53 is disposed between a rear surface of the bottom wall 505 and a front end surface of the bottom wall 471 of the gear sleeve 47. The thrust bearing 53 is subjected to a thrust load while allowing the lead sleeve 500 to rotate relative to the gear sleeve 47. Further, an annular recess having a U-shaped section is formed in each of the rear surface of the bottom wall 505 and the front end surface of the bottom wall 471. Balls, which are rolling elements of the thrust bearing 53, can roll within an annular track defined by these recesses.

The inner diameter of the peripheral wall 504 is set to be slightly larger than the outer diameter of the front end portion of the gear sleeve 47 in which the cam grooves 501 are formed. The peripheral wall 504 is arranged to surround an outer peripheral surface of the front end portion of the gear sleeve 47. As shown in FIG. 11, in the deepest portion of the cam groove 501, a radial distance between a wall surface of the cam groove 501 and an inner peripheral surface of the peripheral wall 504 is set to be slightly larger than the diameter of the ball 502.

By provision of such a structure, the one-way clutch 50 rotates the lead sleeve 500 together with the gear sleeve 47 only when the gear sleeve 47 is rotationally driven in the reverse direction. Specifically, as shown in FIG. 11, when the gear sleeve 47 is rotationally driven in the normal direction (the direction of arrow A in the drawing), the ball 502 moves to the deepest portion of the cam groove 501 (the upstream end portion in the normal direction (the direction of arrow A)) relative to the gear sleeve 47. The ball 502 rotates around the driving axis A1 together with the gear sleeve 47 while being loosely disposed between the wall surface of the cam groove 501 and the inner peripheral surface of the peripheral wall 504. Thus, the one-way clutch 50 is in an interruption state and the rotational force of the gear sleeve 47 is not transmitted to the lead sleeve 500.

Figure 12:
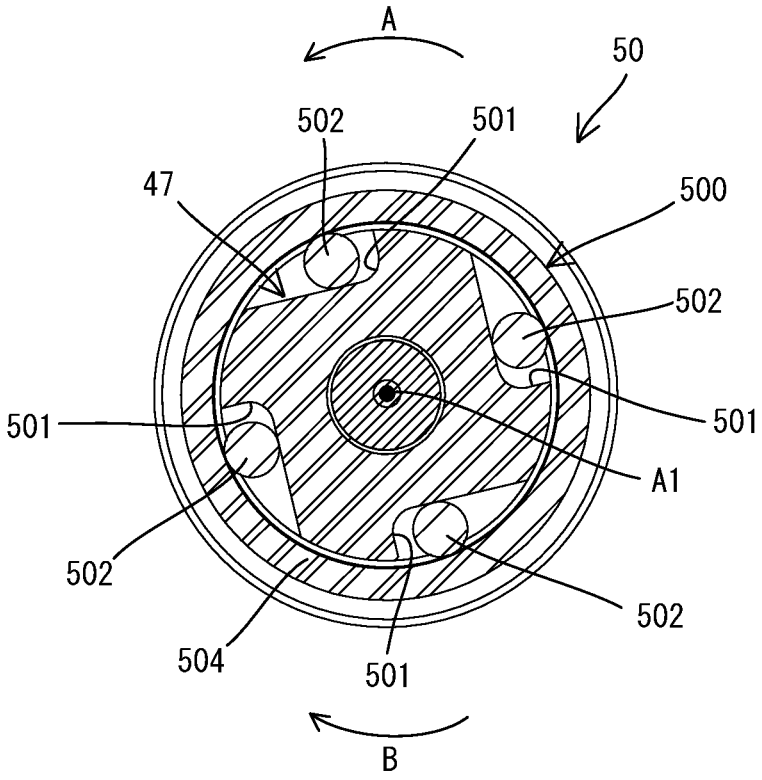
FIG. 12 is a sectional view corresponding to FIG. 11, for illustrating a state of the one-way clutch when the gear sleeve is rotationally driven in a reverse direction.

On the other hand, as shown in FIG. 12, when the gear sleeve 47 is rotationally driven in the reverse direction (the direction of arrow B in the drawing), the ball 502 relatively moves from the deepest portion to a shallower portion (the upstream side in the reverse direction (the direction of arrow B)) of the cam groove 501. As a result, the ball 502 is held between the wall surface of the cam groove 501 and the inner peripheral surface of the peripheral wall 504, so that the gear sleeve 47 and the lead sleeve 500 are integrated together via the balls 502 by frictional force due to the wedge action. In other words, the one-way clutch 50 is shifted to a transmission state and the lead sleeve 500 is rotated together with the gear sleeve 47 in the reverse direction.

The lead grooves 507 and the balls 508 are configured to move the lead sleeve 500 in the front-rear direction relative to the spindle 3 along with rotation of the lead sleeve 500 around the driving axis A1 to thereby also move the gear sleeve 47 in the front-rear direction relative to the retainer 43 and the rollers 45. As shown in FIGS. 5 to 7, in the present embodiment, each of the lead grooves 507 is formed as a spiral groove (strictly speaking, a groove having a shape corresponding to a portion of a spiral) which is formed in the front end surface of the bottom wall 505 of the lead sleeve 500. Three lead grooves 507 are provided to be equidistantly spaced apart in the circumferential direction. More specifically, the depth of the lead groove 507 from its front end surface in the front-rear direction decreases from the upstream side toward the downstream side in the normal direction (screw-tightening direction) of the gear sleeve 47 which is shown by arrow A in FIG. 7 (increases from an upstream side toward a downstream side in the reverse direction (screw-loosening direction) of the gear sleeve 47 which is shown by arrow B in FIG. 7). The steel balls 508 are respectively disposed in the lead grooves 507.

As described above, the gear sleeve 47 is always biased forward by the biasing spring 49 disposed between the retainer 43 and the gear sleeve 47 (specifically, the bearing 48). Therefore, as shown in FIGS. 5 and 6, the thrust bearing 53, the lead sleeve 500 and the balls 508 are also biased forward, and the balls 508 are held in contact with a rear surface of the flange 34. The spindle 3 is also biased forward via the flange 34 and normally held in the initial position.

With such a structure, the relative positional relationship between the spindle 3 and the lead sleeve 500 in the front-rear direction varies according to the positions of the balls 508 within the respective lead grooves 507. More specifically, as shown in FIG. 4, when each of the balls 508 is located in the deepest portion (specifically, the upstream end portion in the normal direction) of the lead groove 507, the distance between the flange 34 and the lead sleeve 500 in the front-rear direction is minimized. Specifically, the lead sleeve 500 is located in a foremost position within a movable range relative to the spindle 3. In a state in which the spindle 3 is located in the initial position, the gear sleeve 47 is located in a most separate position in which the gear sleeve 47 is farthest from the retainer 43 and the rollers 45 in the front-rear direction.

Figure 13:
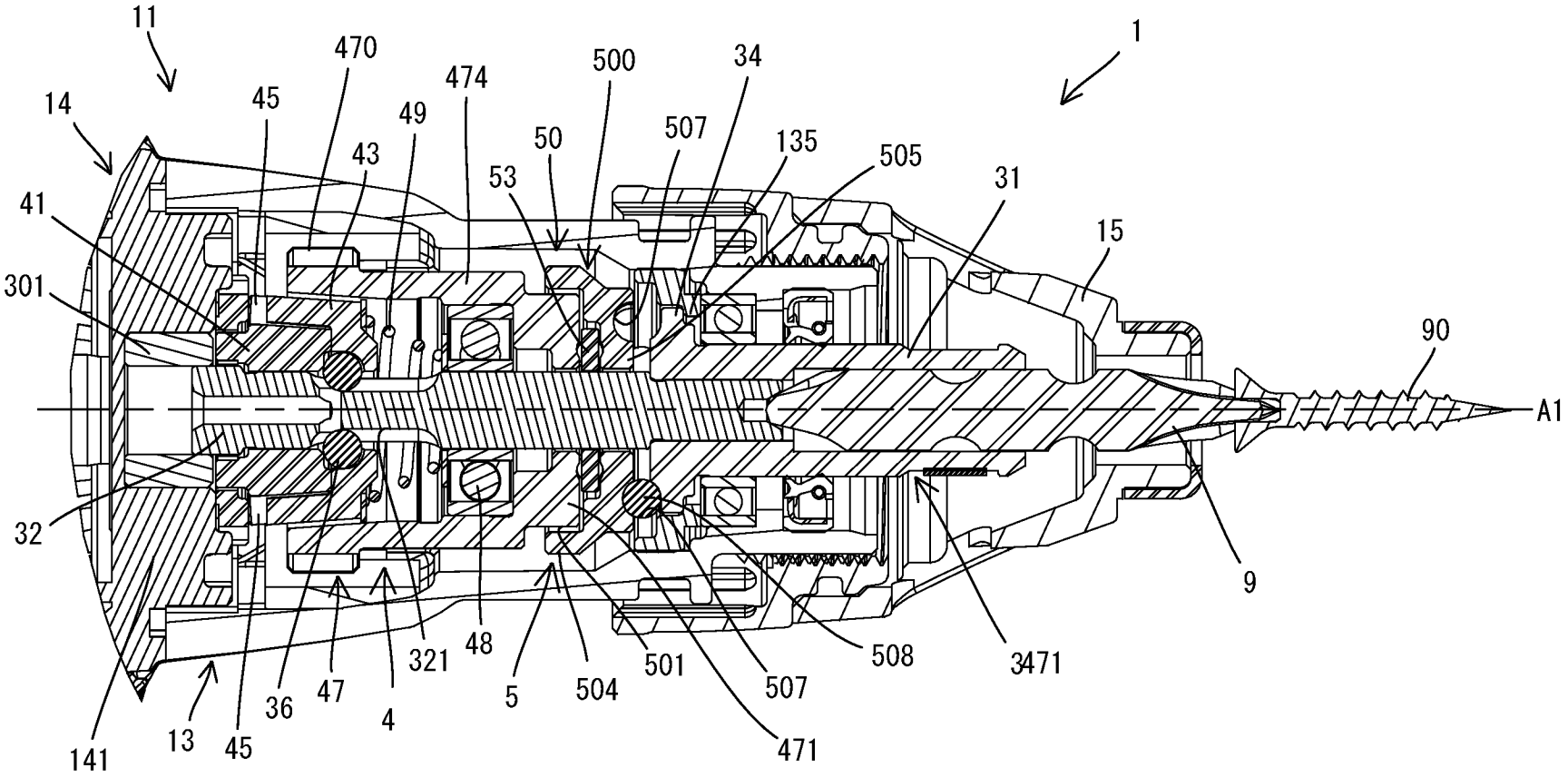
FIG. 13 is a sectional view corresponding to FIG. 4, for illustrating a state in which a lead sleeve and the gear sleeve are moved rearward.

However, when the one-way clutch 50 operates to rotate the lead sleeve 500 together with the gear sleeve 47 in the reverse direction as described above, each of the balls 508 relatively moves from the deepest portion to a shallowest portion (the upstream side in the reverse direction) of the lead groove 507. Since the balls 508 are held in contact with the rear surface of the flange 34, as shown in FIG. 13, the lead sleeve 500 moves in a direction away from the flange 34 (rearward relative to the spindle 3) against the biasing force along with the relative movement of the balls 508. Thus, the lead sleeve 500 moves the gear sleeve 47 rearward relative to the spindle 3, that is, in a direction toward the retainer 43 and the rollers 45 against the biasing force of the biasing spring 49. When each of the balls 508 is placed in the shallowest portion, the distance between the flange 34 and the lead sleeve 500 in the front-rear direction is maximized. In a state in which the spindle 3 is located in the initial position, the gear sleeve 47 is located in an intermediate position, in which the gear sleeve 47 is closer to the retainer 43 and the rollers 45 than in the most separate position. In other words, the relative positions of the gear sleeve 47, the retainer 43 and the rollers 45 are switched from the most separate position to the intermediate position.

Operations of the power-transmitting mechanism 4 and the position-switching mechanism 5 when the motor 2 is driven and the spindle 3 is moved are now described.

First, in an initial state in which the motor 2 is not driven and rearward external force is not applied to the spindle 3, the spindle 3 is held in the initial position by the biasing force of the biasing spring 49. As described above, at this time, as shown in FIGS. 5 and 8, the rollers 45 are in non-frictional-contact with the tapered sleeve 41 and the gear sleeve 47. In other words, the power-transmitting mechanism 4 is in the interruption state.

When the normal direction (screw-tightening direction) is selected as a rotation direction of the motor shaft 23 via the switching lever 175, the screwdriver 1 operates as follows to perform a screw-tightening operation.

When the trigger 173 is depressed by a user and the main switch 174 is turned on while the spindle 3 is located in the initial position, the controller 178 starts driving of the motor 2. Then the gear sleeve 47 is rotationally driven in the normal direction (screw-tightening direction) as shown by arrow A in FIG. 11. As described above, at this time, the one-way clutch 50 does not operate, so that the rotational force of the gear sleeve 47 is not transmitted to the lead sleeve 500. Therefore, the gear sleeve 47, the retainer 43 and the rollers 45 are held in the most separate position. Further, since the power-transmitting mechanism 4 is in the interruption state, the rotational force of the gear sleeve 47 is not transmitted to the spindle 3, so that the gear sleeve 47 idles in the normal direction.

As shown in FIG. 12, the screw-loosening operation described below may be finished while each of the balls 502 is held between the wall surface of the cam groove 501 and the inner peripheral surface of the peripheral wall 504 (that is, the gear sleeve 47, the retainer 43 and the rollers 45 are located in the intermediate position relative to each other). In this case, when the gear sleeve 47 is rotated in the normal direction, the holding of the balls 502 is released and the lead sleeve 500 returns to the foremost position by the biasing force of the biasing spring 49 and by action (cooperation) of the lead grooves 507 and the balls 508. As a result, the gear sleeve 47, the retainer 43 and the rollers 45 return from the intermediate position to the most separate position relative to each other.

In an idling state of the gear sleeve 47, when the user moves the screwdriver 1 forward (toward a workpiece 900) and presses a screw 90 engaged with the driver bit 9 against the workpiece 900, the spindle 3 is pushed rearward relative to the body housing 11 against the biasing force of the biasing spring 49. At this time, the balls 508, the lead sleeve 500, the thrust bearing 53 and the gear sleeve 47 are also pushed rearward together with the spindle 3 relative to the body housing 11 by the flange 34. On the other hand, the tapered sleeve 41 is fixed to the body housing 11, and the retainer 43 and the rollers 45 are held in a state in which the retainer 43 and the rollers 45 are restricted from moving in the front-rear direction relative to the body housing 11. Therefore, the gear sleeve 47 moves rearward toward the tapered sleeve 41, the retainer 43 and the rollers 45, and the distance between the tapered surface 411 of the tapered sleeve 41 and the tapered surface 475 of the gear sleeve 47 in the radial direction gradually decreases.

Accordingly, as shown in FIGS. 9 and 10, the rollers 45 retained by the retainer 43 are held between the tapered surface 411 and the tapered surface 475 in frictional contact therewith (frictional force is generated at contact portions between the rollers 45 and the tapered surfaces 411, 475 due to the wedge action). Specifically, the gear sleeve 47, the retainer 43 and the rollers 45 are placed in a transmitting position where the rotational force of the gear sleeve 47 can be transmitted to the retainer 43 via the rollers 45. The rollers 45 revolve on the tapered surface 411 of the tapered sleeve 41 while rotating by receiving rotation of the gear sleeve 47, thereby causing the retainer 43 to rotate around the driving axis A1. The retainer 43 is integrated with the spindle 3 in the circumferential direction around the driving axis A1, so that the spindle 3 is also rotated together with the retainer 43. In this manner, the power-transmitting mechanism 4 is shifted from the interruption state to the transmission state in response to the rearward movement of the spindle 3 from the initial position, so that an operation of screwing the screw 90 into the workpiece 900 is started. The spindle 3 rotates in the same direction as the gear sleeve 47 at lower speed than the rotation speed of the gear sleeve 47.

Figure 14:
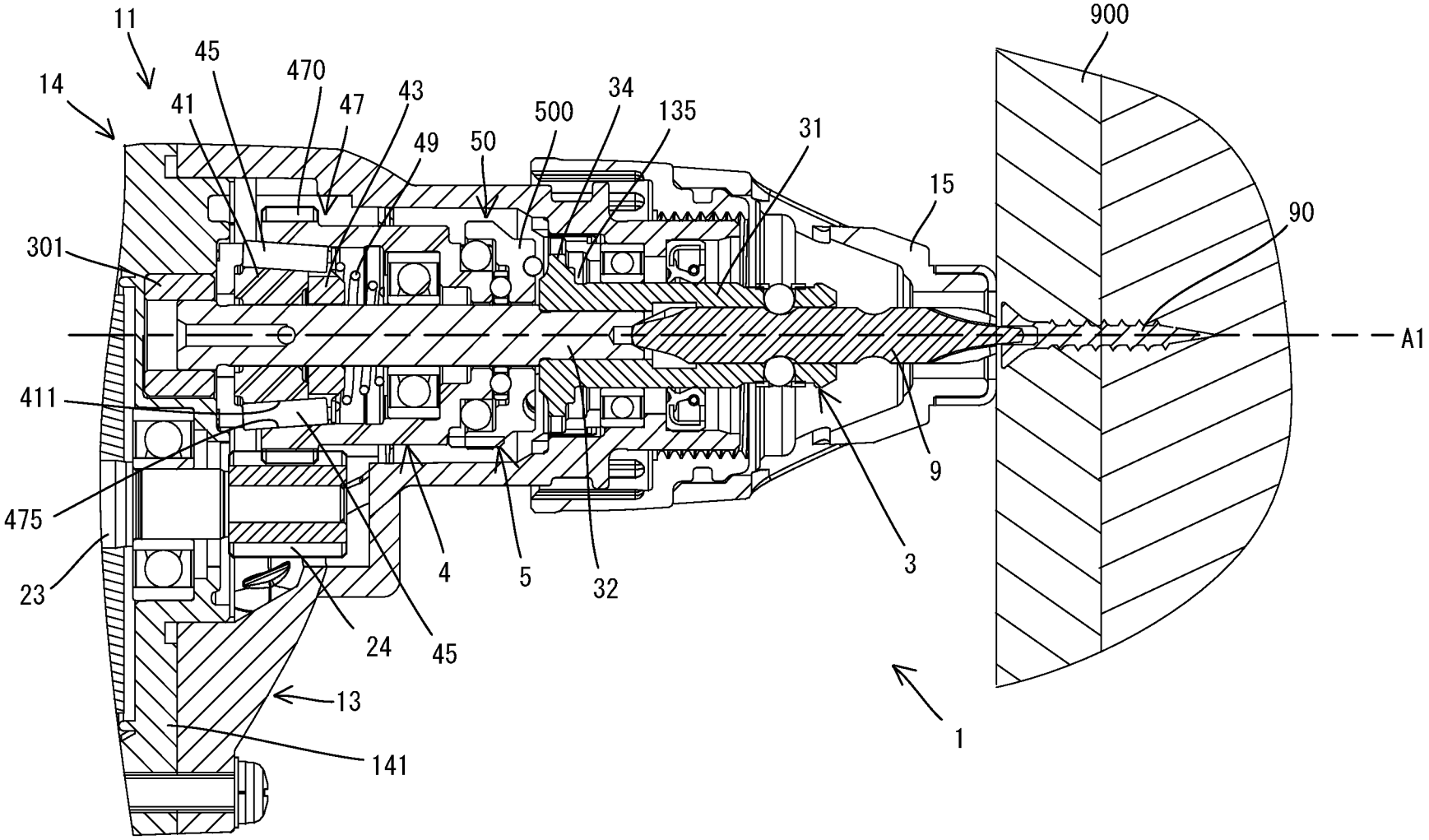
FIG. 14 is a longitudinal section view showing the screwdriver when a locator gets into contact with a workpiece and a screw-tightening operation is completed.

When the operation of screwing the screw 90 into the workpiece 900 proceeds and, as shown in FIG. 14, a front end portion of the locator 15 gets into contact with the workpiece 900, a portion of the screwdriver 1 which is subjected to pressing force shifts from the spindle 3 to the locator 15 and thus the pressing force applied to the spindle 3 is gradually reduced. Therefore, the force of holding the rollers 45 between the tapered surface 411 of the tapered sleeve 41 and the tapered surface 475 of the gear sleeve 47 (which force corresponds to a sum of the pressing force applied to the spindle 3 and the force of biasing the spindle 3 forward by the biasing spring 49) and thus the rotational force transmitted from the gear sleeve 47 to the spindle 3 are also gradually reduced. When the rotational force transmitted from the gear sleeve 47 to the spindle 3 is reduced to below a rotational force required for tightening the screw 90, rotation of the screw 90 is stopped and the screw-tightening operation is finished.

On the other hand, when the reverse direction (screw-loosening direction) is selected as the rotation direction of the motor shaft 23 via the switching lever 175, the screwdriver 1 operates as follows to perform a screw-loosening operation.

When the trigger 173 is depressed by a user and the main switch 174 is turned on while the spindle 3 is located in the initial position, the controller 178 starts driving of the motor 2. Then the gear sleeve 47 is rotationally driven in the reverse direction (screw-loosening direction) as shown by arrow B in FIG. 12, and as described above, the one-way clutch 50 operates to rotate the lead sleeve 500 in the reverse direction. As shown in FIG. 13, by action (cooperation) of the lead grooves 507 and the balls 508, the gear sleeve 47 is moved rearward relative to the spindle 3, that is, in a direction toward the retainer 43 and the rollers 45 against the biasing force of the biasing spring 49. Thus, in the screw-loosening operation, regardless of whether the spindle 3 is moved rearward or not (in a state in which the spindle 3 is located in the initial position), the relative positions of the gear sleeve 47, the retainer 43 and the rollers 45 are switched from the most separate position to the intermediate position in response to rotational driving of the gear sleeve 47 in the reverse direction.

As shown in FIG. 13, when the gear sleeve 47, the retainer 43 and the rollers 45 are placed in the intermediate position, like in the most separate position, the rollers 45 are held apart from the tapered surface 475 in non-frictional-contact with the tapered sleeve 41 and the gear sleeve 47. Therefore, the rotational force of the gear sleeve 47 is not transmitted to the spindle 3. Thus, the power-transmitting mechanism 4 is in the interruption state, so that the gear sleeve 47 idles in the reverse direction.

In the idling state of the gear sleeve 47, when the user moves the screwdriver 1 forward and presses and engages the driver bit 9 with the screw 90 screwed into the workpiece 900, the spindle 3 is pushed rearward relative to the body housing 11 against the biasing force of the biasing spring 49. The gear sleeve 47 moves toward the tapered sleeve 41, the retainer 43 and the rollers 45, and the gear sleeve 47, the retainer 43 and the rollers 45 are placed in the transmitting position. The rollers 45 are held between the tapered surface 411 and the tapered surface 475 in frictional contact therewith, and the power-transmitting mechanism 4 is shifted from the interruption state to the transmission state. Then, the screw 90 is loosened and removed from the workpiece 900.

As described above, in the screw-loosening operation, the gear sleeve 47 is moved further rearward relative to the spindle 3 by the position-switching mechanism 5 than in the screw-tightening operation, so that the distance between the gear sleeve 47 and the retainer 43 (and the rollers 45) in the front-rear direction is shortened. Therefore, a distance by which the spindle 3 moves in the front-rear direction until the gear sleeve 47, the retainer 43 and the rollers 45 move from the intermediate position to the transmitting position relative to each other (in other words, an amount by which the spindle 3 is moved or pushed until the power-transmitting mechanism 4 is shifted from the interruption state to the transmission state during the screw-loosening operation) is shorter than a distance by which the spindle 3 is moved or pushed until the gear sleeve 47, the retainer 43 and the rollers 45 move from the most separate position to the transmitting position relative to each other (an amount by which the spindle 3 is moved or pushed until the power-transmitting mechanism 4 is shifted from the interruption state to the transmission state during the screw-tightening operation). In the present embodiment, the moving distance of the spindle 3 during the screw-loosening operation is set to be about 1 millimeter shorter than that of the spindle 3 during the screw-tightening operation. As a result, the user can loosen the screw 90 screwed into the workpiece 900 without removing the locator 15 from the front housing 13.

In the above-described description of the operation of the screwdriver 1, an example is given in which the spindle 3 is pushed rearward after start of driving of the motor 2, but the operation of the screwdriver 1 is basically the same even in a case where driving of the motor 2 is started before the spindle 3 is pushed rearward and the power-transmitting mechanism 4 is shifted to the transmission state. In the screw-loosening operation, depending on the position of the spindle 3, the power-transmitting mechanism 4 may be shifted to the transmission state when the gear sleeve 47 is moved rearward by the position-switching mechanism 5 in response to start of driving of the motor 2. Further, in a case where the spindle 3 is pushed rearward and driving of the motor 2 is started after the power-transmitting mechanism 4 is shifted to the transmission state, rotational driving of the spindle 3 is started in response to the start of driving of the motor 2.

As described above, in the power-transmitting mechanism 4 of the screwdriver 1 of the present embodiment, in both of a case in which the gear sleeve 47 is rotationally driven in the normal direction for a screw-tightening operation and a case in which the gear sleeve 47 is rotationally driven in the reverse direction for a screw-loosening operation, the rotational force of the gear sleeve 47 is transmitted to the retainer 43 via the rollers 45. Specifically, power is transmitted via the same path during the screw-tightening operation and the screw-loosening operation. In a case where the gear sleeve 47 is rotationally driven in the reverse direction for a screw-loosening operation while the spindle 3 is located in the initial position, the position-switching mechanism 5 moves the gear sleeve 47 in a direction toward the retainer 43 and the rollers 45 (rearward). In other words, in the screw-loosening operation, even if the spindle 3 is not pushed rearward, the distances between the gear sleeve 47 and the retainer 43 and between the gear sleeve 47 and the rollers 45 in the front-rear direction are shortened in response to rotational driving of the gear sleeve 47 in the reverse direction. Thus, the amount of rearward movement (push) of the spindle 3 which is required to shift the power-transmitting mechanism 4 to the transmission state can be made smaller than that in the screw-tightening operation. In this manner, according to the present embodiment, the rational power-transmitting mechanism 4 is realized which is capable of transmitting power via the same path during the screw-tightening operation and the screw-loosening operation and is configured such that the screw-loosening operation can be performed in response to a smaller amount of push than in the screw-tightening operation.

In the present embodiment, the position-switching mechanism 5 is configured to convert rotation around the driving axis A1 into linear motion in the front-rear direction in response to the reverse rotational driving of the gear sleeve 47 and thereby move the gear sleeve 47 rearward relative to the spindle 3. In other words, the position-switching mechanism 5 is configured as a motion converting mechanism. Particularly, in the present embodiment, the position-switching mechanism 5 is configured to move the lead sleeve 500 by action (cooperation) of the spiral lead grooves 507 formed in the lead sleeve 500 and the balls 508 rolling within the lead grooves 507 and thereby move the gear sleeve 47 rearward relative to the spindle 3. With this structure, the smoothly operating position-switching mechanism 5 is realized.

Further, in the present embodiment, only when the gear sleeve 47 is rotationally driven in the reverse direction, the one-way clutch 50 of the position-switching mechanism 5 rotates the lead sleeve 500 together with the gear sleeve 47 around the driving axis A1, so that the position-switching mechanism 5 moves the lead sleeve 500 rearward relative to the spindle 3 and thereby moves the gear sleeve 47 rearward. Thus, in the present embodiment, a rational structure is realized for promptly rotating the lead sleeve 500 in response to the reverse rotational driving of the gear sleeve 47 and thereby moving the gear sleeve 47.

In the present embodiment, the power-transmitting mechanism 4 is configured as a friction-type clutch mechanism (specifically, a planetary-roller-type friction clutch mechanism). Therefore, compared with a dog-clutch-type clutch mechanism, generation of noise during engagement (frictional contact) between the gear sleeve 47 and the rollers 45 and wear of the rollers 45 and the tapered surfaces 411, 475 can be reduced. Further, the power-transmitting mechanism 4 is configured as a planetary speed-reducing mechanism, so that both the power transmitting/transmission interrupting function and the speed reducing function are realized by a single mechanism. Further, the gear sleeve 47 has the gear teeth 470 which are engaged with the pinion gear 24 provided on the motor shaft 23. Thus, a rational structure for efficiently transmitting power from the motor 2 to the power-transmitting mechanism 4 is realized.

Second Embodiment

A screwdriver 100 according to a second embodiment is now described with reference to FIGS. 15 to 19. The screwdriver 100 of the present embodiment includes a power-transmitting mechanism 6 and a position-switching mechanism 7 which are different from the power-transmitting mechanism 4 and the position-switching mechanism 5 (see FIGS. 5 and 7) of the first embodiment, but the other structures are substantially the same as those of the screwdriver 1. Therefore, in the following description, structures which are substantially identical to those of the first embodiment are given the same numerals as in the first embodiment and are not or briefly described, and different structures are mainly described.

Figure 15:
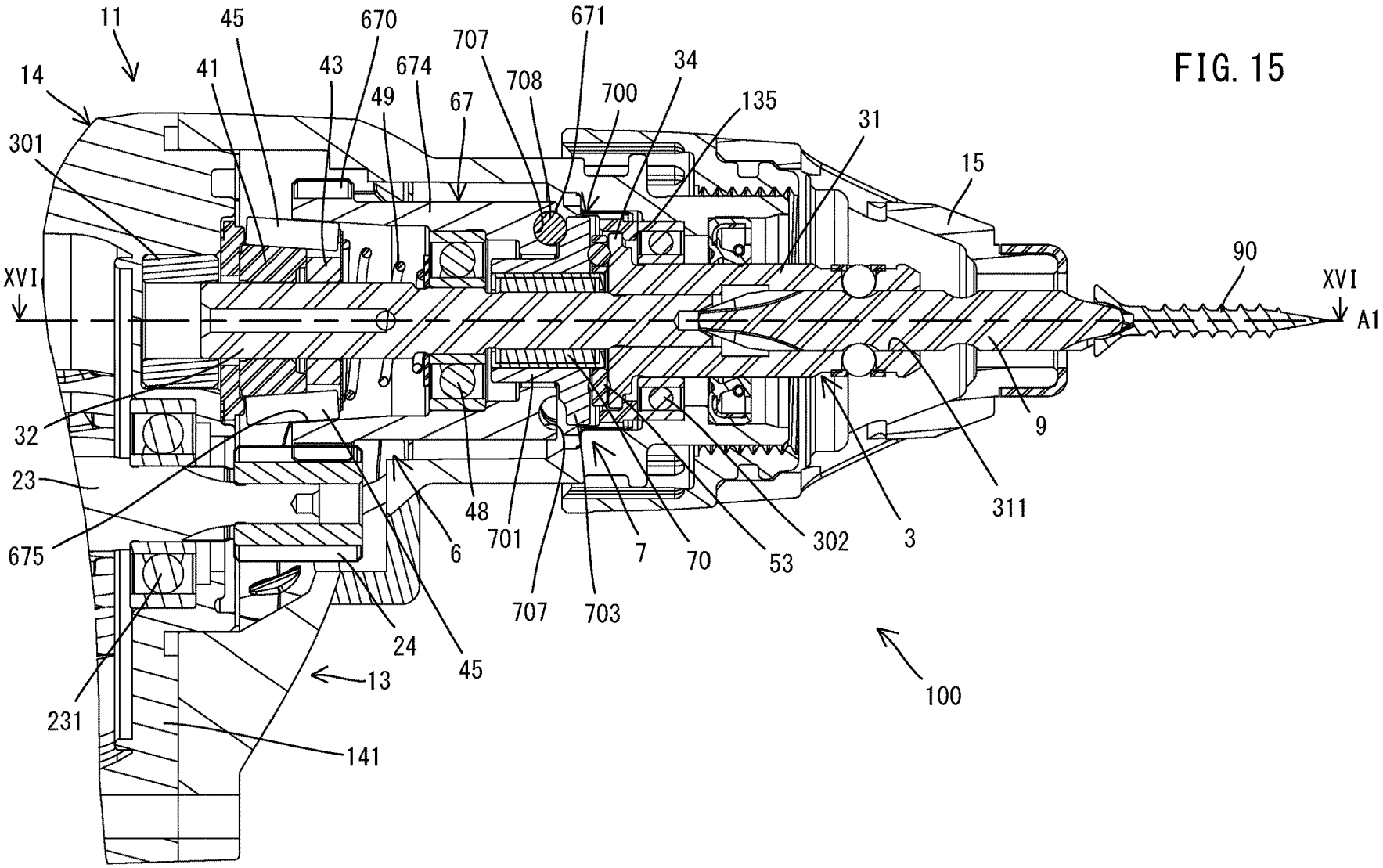
FIG. 15 is a longitudinal section view of a screwdriver according to a second embodiment.
Figure 16:
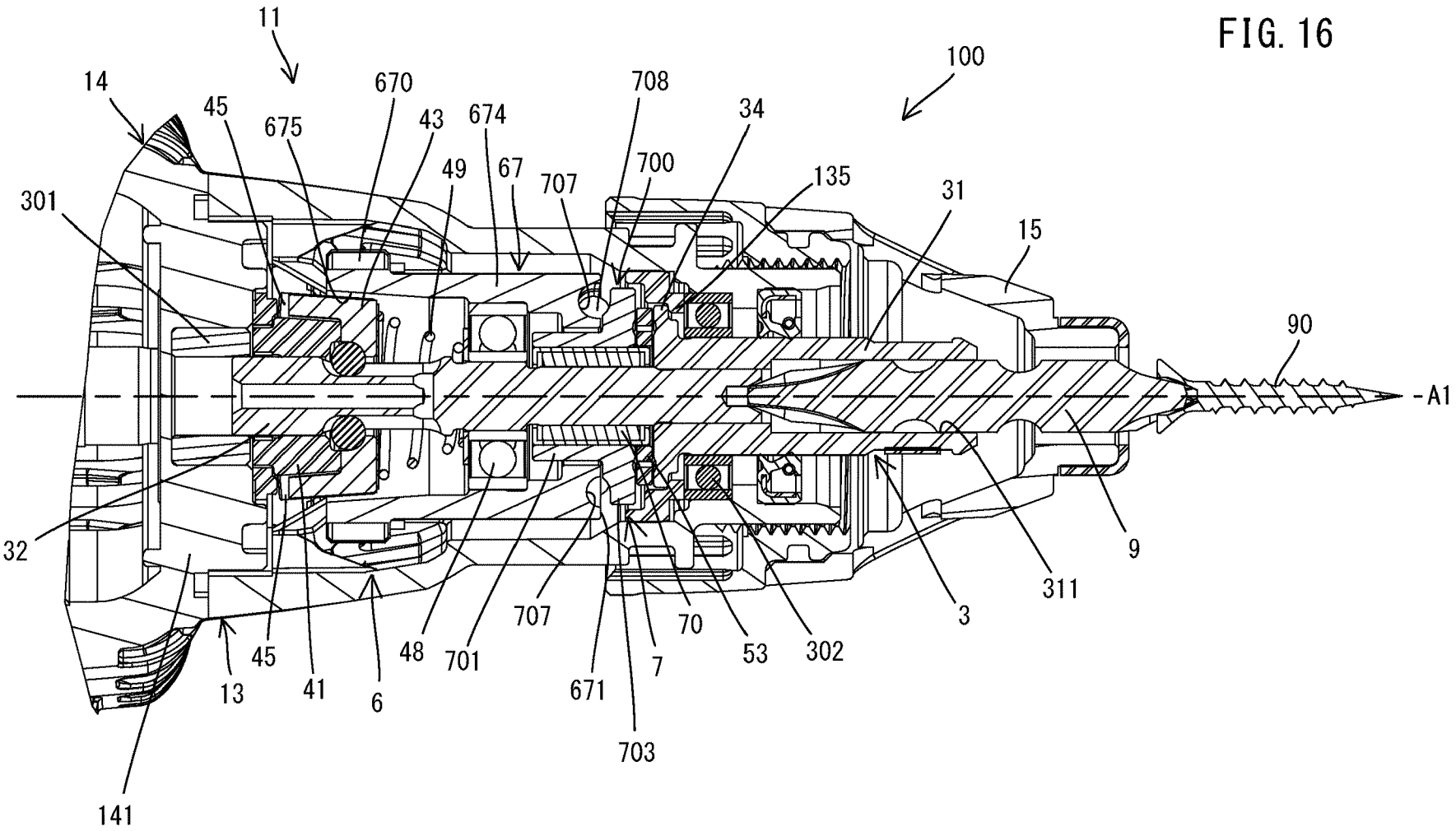
FIG. 16 is a sectional view taken along line XVI-XVI in FIG. 15.
Figure 17:
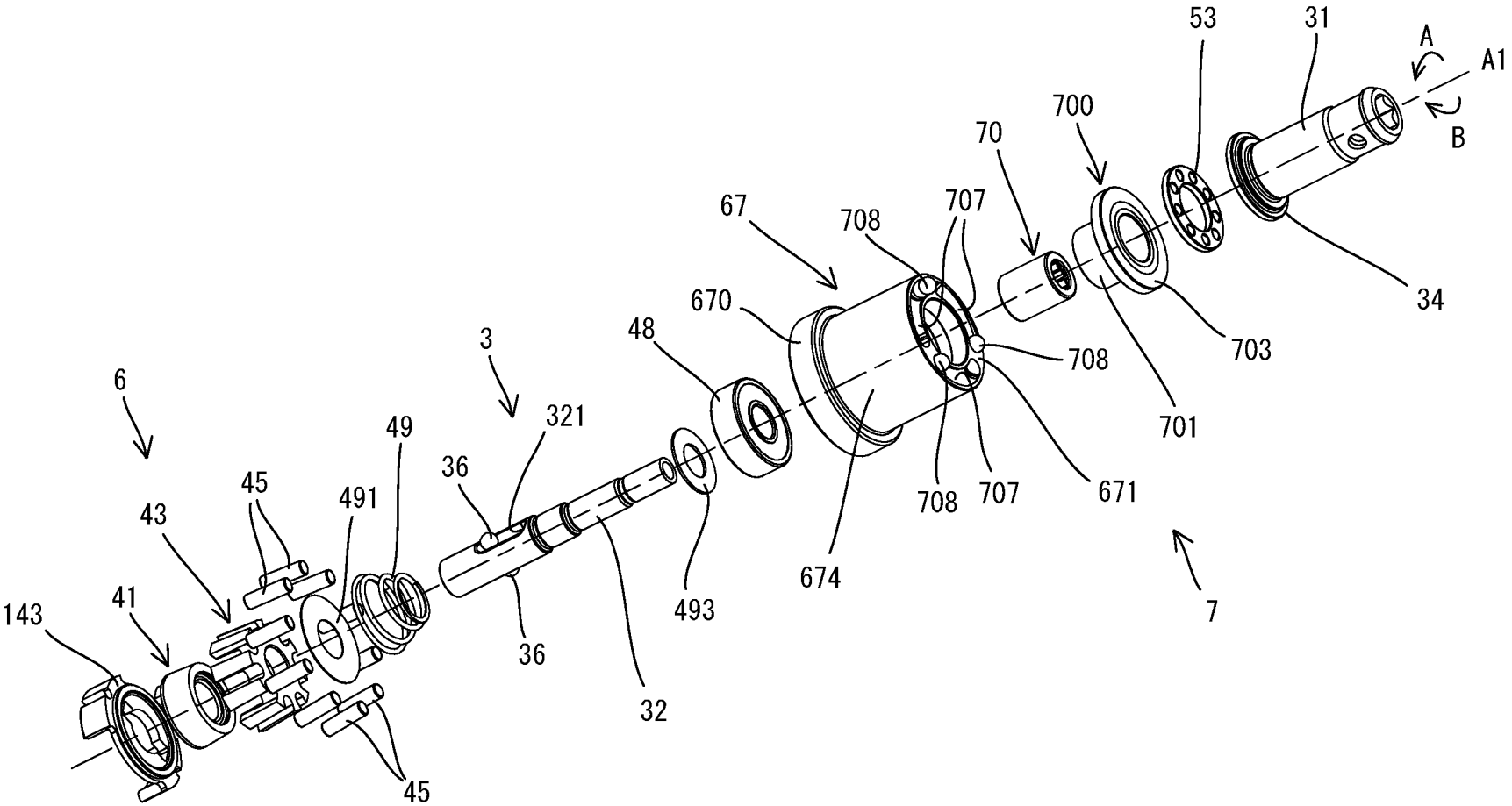
FIG. 17 is an exploded perspective view showing a spindle, a power-transmitting mechanism and a position-switching mechanism.

As shown in FIGS. 15 to 17, the power-transmitting mechanism 6 of the present embodiment mainly includes a planetary mechanism including the tapered sleeve 41, the retainer 43, the plurality of rollers 45 and a gear sleeve 67 which are coaxially arranged. The structures of the power-transmitting mechanism 6 other than the gear sleeve 67 are substantially the same as those of the power-transmitting mechanism 4 of the first embodiment.

The gear sleeve 67 of the present embodiment is configured as a generally cup-shaped member having an inner diameter larger than the outer diameters of the tapered sleeve 41 and the retainer 43 and has the same structure as the gear sleeve 47 of the first embodiment except for the structure of its front end portion. More specifically, the gear sleeve 67 has a bottom wall 671 having a through hole and a cylindrical peripheral wall 674 contiguous to the bottom wall 671. The gear sleeve 67 is supported by the spindle 3 in front of the retainer 43 so as to be rotatable and movable in the front-rear direction relative to the spindle 3. Portions of the tapered sleeve 41, the retainer 43 and the rollers 45 as well as the biasing spring 49 are disposed in an internal space of the gear sleeve 67. Further, gear teeth 670, which are always engaged with the pinion gear 24, are integrally formed on an outer periphery of the gear sleeve 67 (specifically, the peripheral wall 674). Like the peripheral wall 474 of the first embodiment, an inner peripheral surface of the peripheral wall 674 includes a tapered surface 675 which is inclined relative to the driving axis A1, at the same angle as the tapered surface 411 of the tapered sleeve 41 (in other words, extends in parallel to the tapered surface 411).

Unlike the gear sleeve 47 of the first embodiment, the gear sleeve 67 of the present embodiment has lead grooves 707 formed in its front end portion (specifically, a front end surface of the bottom wall 671). Each of the lead grooves 707 has the same structure as the lead groove 507 of the lead sleeve 500 of the first embodiment. Specifically, the lead groove 707 is formed as a spiral groove (strictly speaking, a groove having a shape corresponding to a portion of a spiral). Three lead grooves 707 are provided to be equidistantly spaced apart in the circumferential direction. The depth of the lead groove 707 from its front end surface in the front-rear direction decreases from an upstream side toward a downstream side in the normal direction (screw-tightening direction) of the gear sleeve 67 which is shown by arrow A in FIG. 17 (increases from an upstream side toward a downstream side in the reverse direction (screw-loosening direction) of the gear sleeve 67 which is shown by arrow B in FIG. 17).

Like the position-switching mechanism 5 of the first embodiment, the position-switching mechanism 7 of the present embodiment is a mechanism configured to relatively move the gear sleeve 67 and the front end portion of the spindle 3 in directions away from each other in the front-rear direction when the gear sleeve 67 is rotationally driven in the reverse direction (screw-loosening direction). With such a structure, when the gear sleeve 67 is rotationally driven in the reverse direction (screw-loosening direction) while the spindle 3 is located in the initial position, the position-switching mechanism 7 moves the gear sleeve 67 rearward relative to the spindle 3 toward the retainer 43 and the rollers 45.

As shown in FIGS. 15 to 17, in the present embodiment, the position-switching mechanism 7 mainly includes a one-way clutch 70, a flange sleeve 700, the lead grooves 707 formed in the gear sleeve 67 and balls 708.

In the present embodiment, a known general-purpose one-way clutch is employed as the one-way clutch 70. The one-way clutch 70 has a circular cylindrical shape, and is fitted onto the rear shaft 32 behind the flange 34 of the spindle 3. The one-way clutch 70 is configured to be rotatable in the normal direction and non-rotatable in the reverse direction relative to the spindle 3. The flange sleeve 700 has a cylindrical peripheral wall 701 and a flange 703 protruding radially outward from a front end portion of the peripheral wall 701. An annular recess is formed in an outer edge portion of a rear surface of the flange 703 and held in contact with the balls 708. The peripheral wall 701 is fixed to an outer periphery of the one-way clutch 70. The thrust bearing (specifically, thrust ball bearing) 53 is disposed between the rear surface of the flange 34 of the spindle 3 and a front surface of the flange 703 of the flange sleeve 700 in the front-rear direction. The thrust bearing 53 is subjected to a thrust load while allowing the flange sleeve 700 to rotate relative to the spindle 3. Further, an annular recess having a U-shaped section is formed in each of the rear surface of the flange 34 and the front surface of the flange 703. Balls, which are rolling elements of the thrust bearing 53, can roll within an annular track defined by these recesses.

The lead grooves 707 and the balls 708 are configured to move the gear sleeve 67 in the front-rear direction relative to the spindle 3 along with rotation of the gear sleeve 67 around the driving axis A1 relative to the flange sleeve 700, and thereby move the gear sleeve 67 in the front-rear direction relative to the retainer 43 and the rollers 45. As described above, in the present embodiment, each of the lead grooves 707 is formed in the front end surface of the bottom wall 671 of the gear sleeve 67. The steel balls 708 are respectively disposed in the lead grooves 707.

As described above, the gear sleeve 67 is always biased forward by the biasing spring 49 disposed between the retainer 43 and the gear sleeve 67 (specifically, the bearing 48). Therefore, as shown in FIGS. 15 and 16, the spindle 3 is also biased forward via the balls 708, the flange sleeve 700 and the thrust bearing 53 and normally held in the initial position.

With such a structure, the relative positional relationship between the spindle 3/the flange sleeve 700 and the gear sleeve 67 in the front-rear direction varies according to the positions of the balls 708 within the respective lead grooves 707. More specifically, as shown in FIGS. 15 and 16, when each of the balls 708 is located in the deepest portion (specifically, an upstream end portion in the normal direction) of the lead groove 707, the distance between the flange 703 and the gear sleeve 67 in the front-rear direction is minimized. Specifically, the gear sleeve 67 is located in a foremost position within a movable range relative to the spindle 3. In a state in which the spindle 3 is located in the initial position, the gear sleeve 67 is located in a most separate position in which the gear sleeve 67 is farthest from the retainer 43 and the rollers 45 in the front-rear direction.

At this time, the balls 708 within the lead grooves 707 are pressed against and engaged with the annular recess formed in the outer edge portion of the rear surface of the flange 703 by the biasing force of the biasing spring 49. As described above, the one-way clutch 70 and the flange sleeve 700 are rotatable in the normal direction relative to the spindle 3. Therefore, when the gear sleeve 67 is rotationally driven in the normal direction, the flange sleeve 700 is rotated together with the gear sleeve 67 in the normal direction by frictional force between the flange 703 and the balls 708 respectively held in the deepest portions of the lead grooves 707. Thus, when the gear sleeve 67 is rotationally driven in the normal direction, the one-way clutch 70 allows the flange sleeve 700 to rotate together with the gear sleeve 67.

Figure 18:
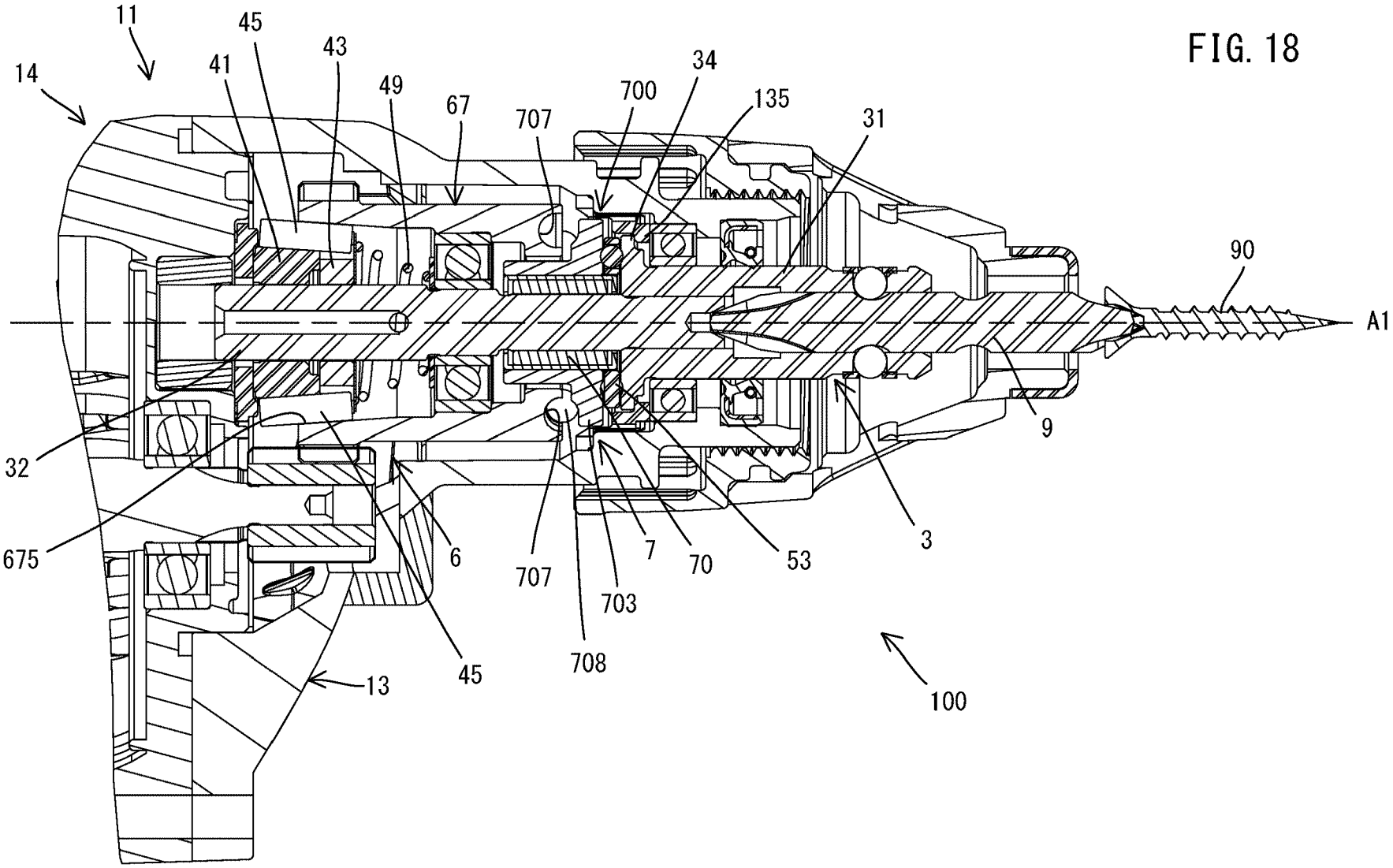
FIG. 18 is a sectional view corresponding to FIG. 15, for illustrating a state in which the gear sleeve is moved rearward.
Figure 19:
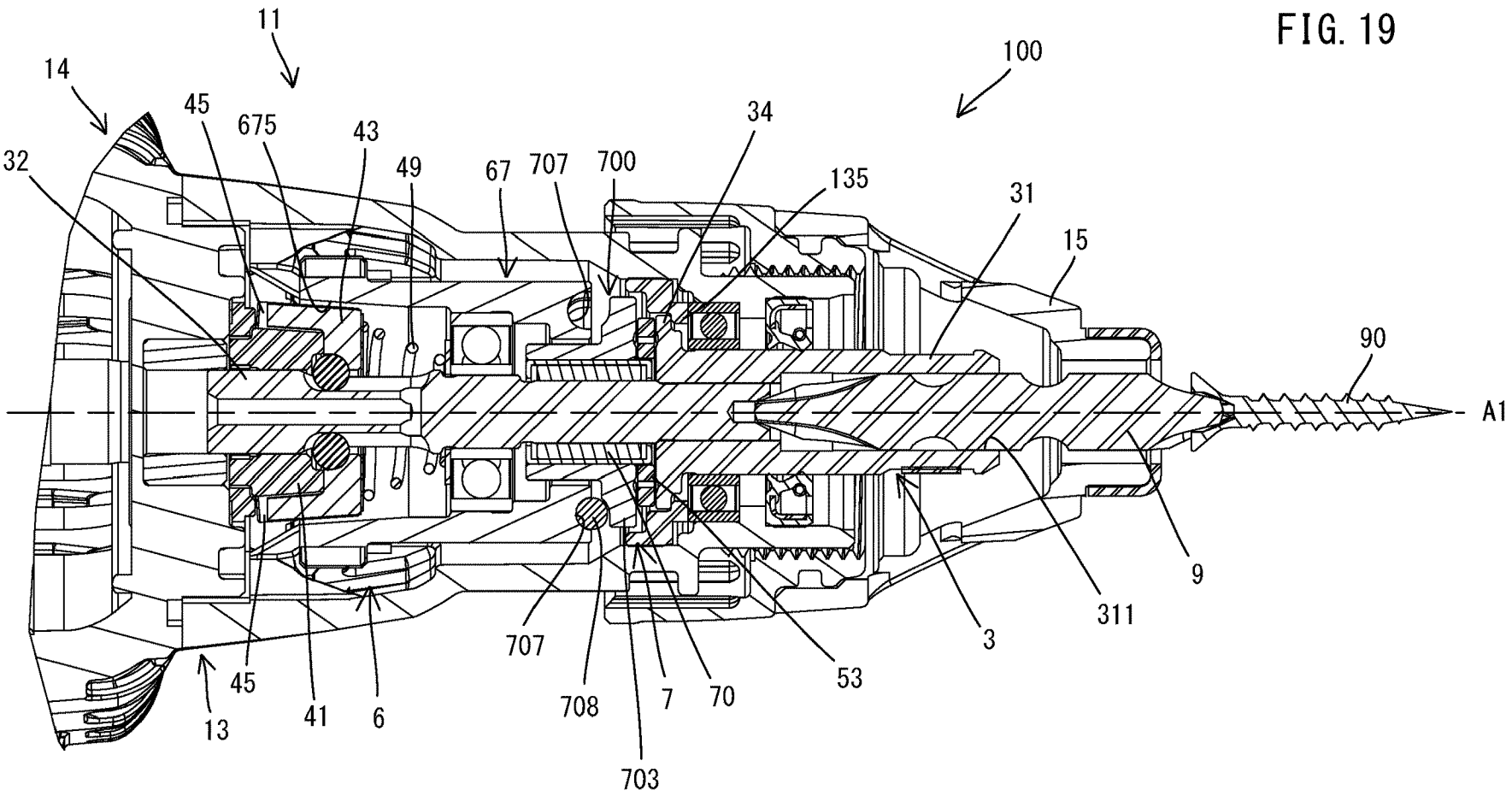
FIG. 19 is a sectional view corresponding to FIG. 16, for illustrating a state in which the gear sleeve is moved rearward.

However, as described above, the one-way clutch 70 cannot rotate in the reverse direction relative to the spindle 3. Therefore, when the gear sleeve 67 is rotationally driven in the reverse direction, the one-way clutch 70 prevents the flange sleeve 700 from rotating in the reverse direction relative to the spindle 3. Thus, the flange sleeve 700 is integrated with the spindle 3. Therefore, the gear sleeve 67 rotates in the reverse direction relative to the flange sleeve 700. At this time, each of the balls 708 relatively moves from the deepest portion to a shallowest portion (the upstream side in the reverse direction) of the lead groove 707. Since the balls 708 are held in contact with the rear surface of the flange 703, as shown in FIGS. 18 and 19, along with the relative movement of the balls 708, the gear sleeve 67 moves in a direction away from the flange 703 (rearward relative to the spindle 3), that is, in a direction toward the retainer 43 and the rollers 45, against the biasing force of the biasing spring 49 while rotating in the reverse direction. When each of the balls 708 is placed in the shallowest portion, the distance between the flange 703 and the gear sleeve 67 in the front-rear direction is maximized. In a state in which the spindle 3 is located in the initial position, the gear sleeve 67 is located in an intermediate position, in which the gear sleeve 67 is closer to the retainer 43 and the rollers 45 than in the most separate position. In other words, the relative positions of the gear sleeve 67, the retainer 43 and the rollers 45 are switched from the most separate position to the intermediate position.

As described above, in the screwdriver 100 of the present embodiment, when the gear sleeve 67 is rotationally driven in the reverse direction for a screw-loosening operation in a state in which the spindle 3 is located in the initial position, the position-switching mechanism 7 also moves the gear sleeve 67 in a direction toward the retainer 43 and the rollers 45 (rearward). In other words, in the screw-loosening operation, even if the spindle 3 is not pushed rearward, the distances between the gear sleeve 67 and the retainer 43 and between the gear sleeve 67 and the rollers 45 in the front-rear direction are shortened in response to rotational driving of the gear sleeve 67 in the reverse direction. Thus, an amount of rearward movement (push) of the spindle 3 which is required to shift the power-transmitting mechanism 6 to the transmission state can be made smaller than that in the screw-tightening operation.

In the present embodiment, the position-switching mechanism 7 is also configured as a motion converting mechanism which converts rotation around the driving axis A1 into linear motion in the front-rear direction in response to the reverse rotational driving of the gear sleeve 67 and thereby moves the gear sleeve 67 rearward relative to the spindle 3. Particularly, in the present embodiment, the position-switching mechanism 7 is configured to move the gear sleeve 67 rearward relative to the spindle 3 by action (cooperation) of the spiral lead grooves 707 formed in the gear sleeve 67 and the balls 708 rolling within the lead grooves 707. With this structure, the smoothly operating position-switching mechanism 7 is realized. Further, in the present embodiment, when the gear sleeve 67 is rotationally driven in the reverse direction, the one-way clutch 70 of the position-switching mechanism 7 prevents the flange sleeve 700 from rotating in the reverse direction relative to the spindle 3 (integrates the flange sleeve 700 with the spindle 3), so that the position-switching mechanism 7 rotates the gear sleeve 67 relative to the flange sleeve 700 and thereby moves the gear sleeve 67 rearward relative to the spindle 3. Thus, in the present embodiment, a rational structure is realized for promptly moving the gear sleeve 67 in the front-rear direction in response to the reverse rotational driving of the gear sleeve 67.

Third Embodiment

A screwdriver 110 according to a third embodiment is now described with reference to FIGS. 20 to 23. Further, the screwdriver 110 of the present embodiment has a power-transmitting mechanism 8 which is different from that in the screwdriver 110 of the second embodiment (see FIGS. 15 to 17), but the other structures are substantially the same as those of the screwdriver 100. Therefore, in the following description, structures which are substantially identical to those of the screwdriver 100 are given the same numerals and are not or briefly described, and different structures are mainly described.

Figure 20:
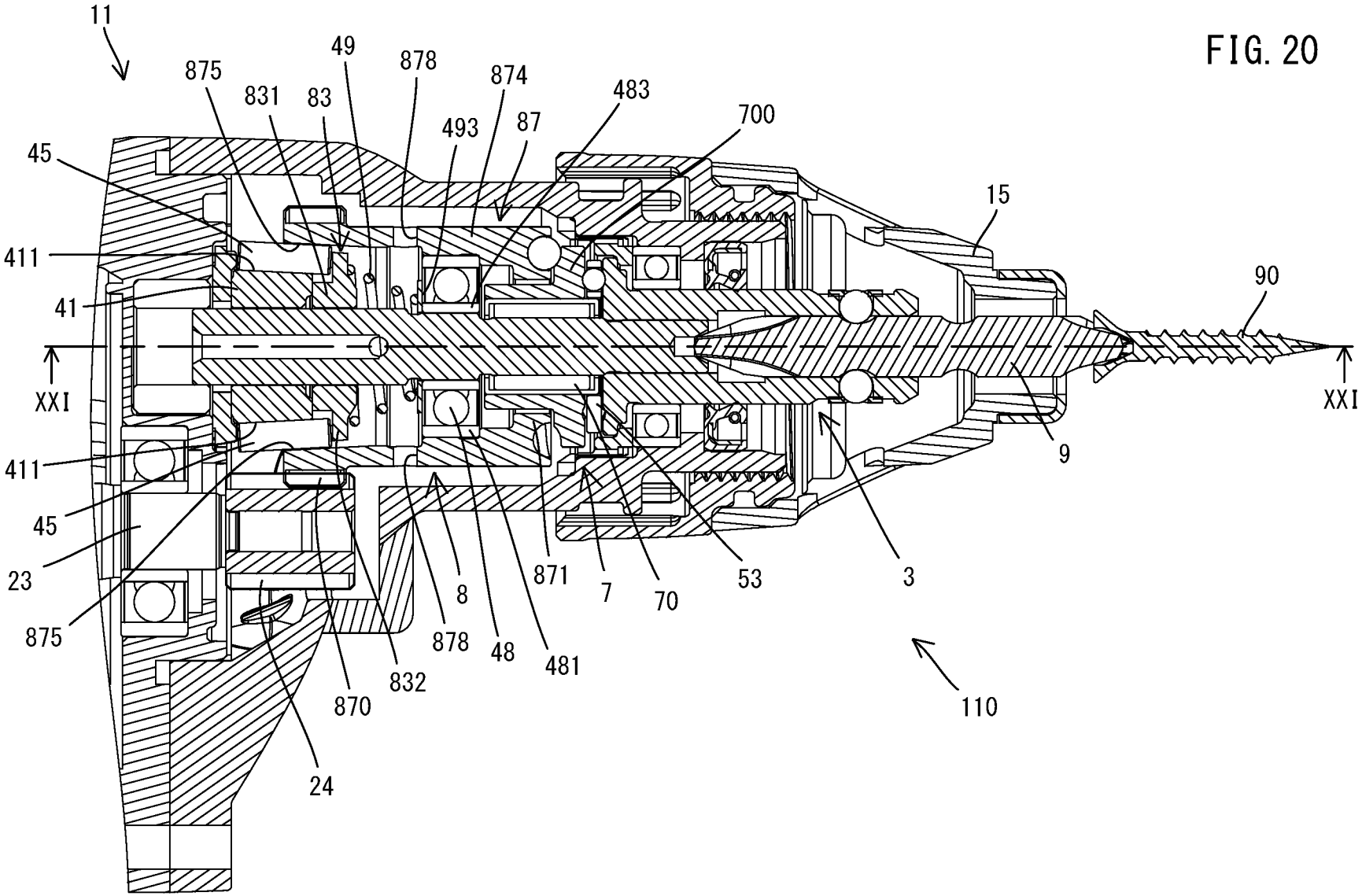
FIG. 20 is a longitudinal section view of a screwdriver according to a third embodiment.
Figure 21:
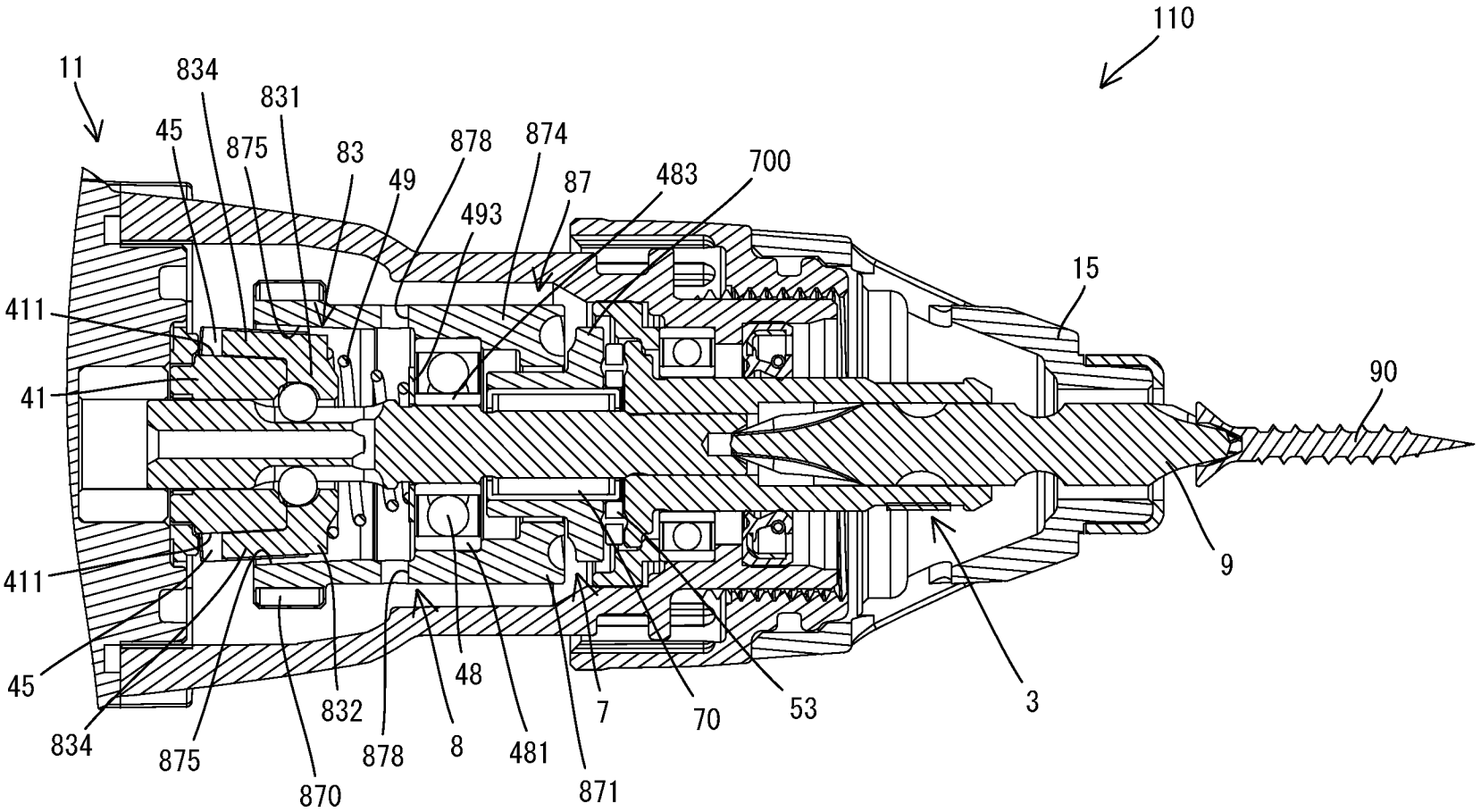
FIG. 21 is a sectional view taken along line XXI-XXI in FIG. 20.
Figure 22:
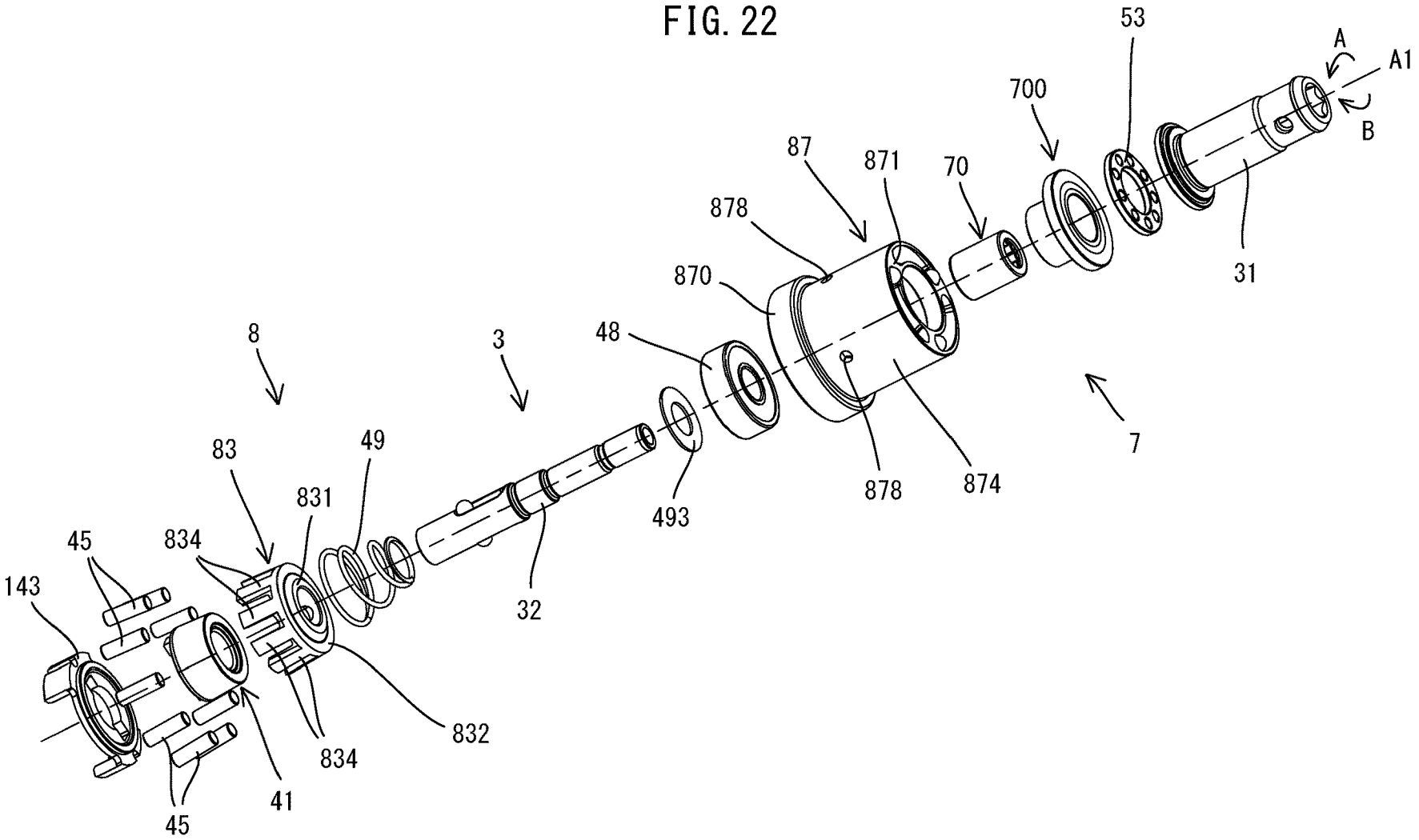
FIG. 22 is an exploded perspective view showing a spindle, a power-transmitting mechanism and a position-switching mechanism.

As shown in FIGS. 20 to 22, the power-transmitting mechanism 8 of the present embodiment mainly includes a planetary mechanism including the tapered sleeve 41, a retainer 83, the plurality of rollers 45 and a gear sleeve 87 which are coaxially arranged. The structures of the power-transmitting mechanism 8 other than the retainer 83 and the gear sleeve 87 are substantially the same as those of the power-transmitting mechanism 6 (see FIGS. 15 to 17).

Like the retainer 43 (see FIGS. 15 to 17) of the second embodiment, the retainer 83 of the present embodiment corresponds to a carrier member in the planetary mechanism, and is configured to rotatably hold the rollers 45. The retainer 83 has the same structure as the retainer 43 except for the structure of its front end portion. More specifically, the retainer 83 has a generally circular cylindrical bottom wall 831 having a through hole in its center, an annular flange part 832 protruding radially outward from a front end portion of the bottom wall 831, and a plurality of retaining arms 834 protruding rearward from a rear surface of a peripheral edge portion of the flange part 832. The bottom wall 831 and the retaining arms 834 have substantially the same structures as the bottom wall 431 and the retaining arms 434 of the retainer 43. With such a structure, spaces for retaining the rollers 45 are formed between the retaining arms 834 adjacent to each other in the circumferential direction and each of the retaining spaces has a front end which is closed by the flange part 832. In the present embodiment, the washer 491 (see FIGS. 15 to 17) is omitted, but instead, a front surface of the flange part 832 functions as a spring-receiving part for receiving a rearward biasing force of the biasing spring 49. Further, a rear surface of the flange part 832 functions as a restricting surface for restricting forward movement of the rollers 45 by contact with the front ends of the rollers 45.

Like the retainer 43, the retainer 83 is arranged with the bottom wall 831 on the front side (such that the retaining arms 834 protrude rearward). Further, the retainer 83 is supported by the spindle 3 so as to be non-rotatable and movable in the front-rear direction relative to the spindle 3 in a state in which the retaining arms 834 are partially overlapped with the tapered sleeve 41 in the radial direction. Each of the retaining arms 834 protrudes rearward from the rear surface of the peripheral edge portion of the flange part 832 at the same inclination angle as the tapered surface 411 of the tapered sleeve 41 relative to the driving axis A1.

The gear sleeve 87 of the present embodiment is configured as a generally cup-shaped member having substantially the same structure as the gear sleeve 67 of the second embodiment (see FIGS. 15 to 17). More specifically, the gear sleeve 87 has a generally circular bottom wall 871 having a through hole in its center and a cylindrical peripheral wall 874 contiguous to the bottom wall 871. The bottom wall 871 has substantially the same structure as the bottom wall 671 of the gear sleeve 67. The basic structure of the peripheral wall 874 is the same as that of the peripheral wall 674 of the gear sleeve 67 except that the peripheral wall 874 has communication holes 878 described below. Specifically, the outer ring 481 of the bearing 48 is fixed within a front end portion of the peripheral wall 874. Further, gear teeth 870, which are always engaged with the pinion gear 24, are integrally formed on an outer periphery of the gear sleeve 87 (specifically, the peripheral wall 874).

Figure 23:
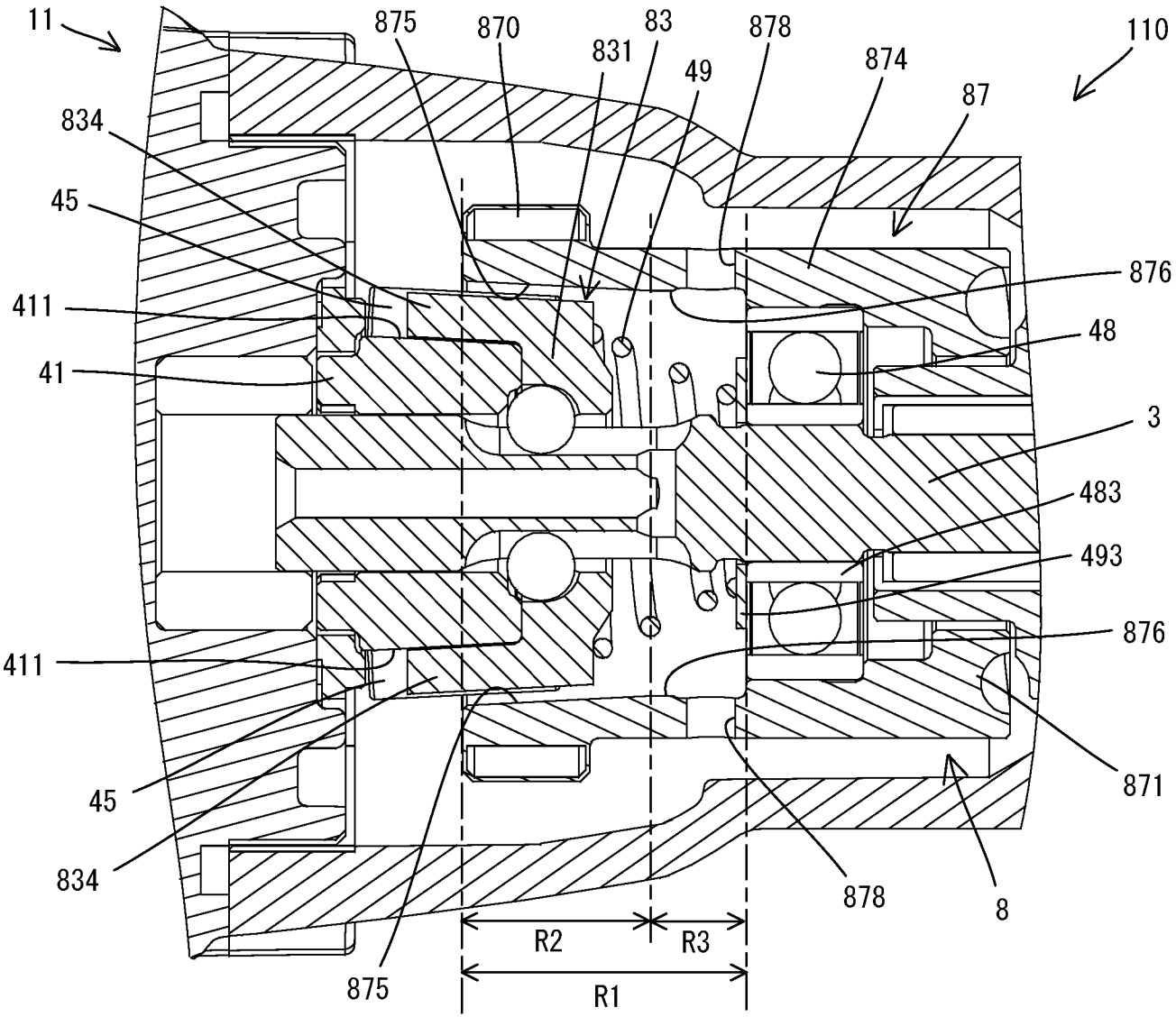
FIG. 23 is a partial, enlarged view of FIG. 21.

As shown in FIG. 23, a portion of an inner peripheral surface of the peripheral wall 874 which extends rearward of a rear end of the bearing 48 includes a tapered surface 875 and a cylindrical surface 876. The tapered surface 875 is a conical surface which is inclined at the same angle as the tapered surface 411 of the tapered sleeve 41 relative to the driving axis A1. The tapered surface 875 occupies a rear half of the inner peripheral surface of the peripheral wall 874. The cylindrical surface 876 is contiguous to a front end of the tapered surface 875 and extends in a generally cylindrical shape along the driving axis A1.

Each of the communication holes 878 is a through hole extending through the peripheral wall 874 in the radial direction and provides communication between the inside (internal space) and the outside of the gear sleeve 87. In the present embodiment, in a region R1 (specifically, a region defining the internal space of the gear sleeve 87) extending from a rear end of the peripheral wall 874 to the rear end of the bearing 48, the communication holes 878 are formed in a region that is different from a region R2 corresponding to the tapered surface 875, that is, a region R3 corresponding to the cylindrical surface 876. In other words, the communication holes 878 are arranged in a region which is not normally overlapped with the rollers 45 in the radial direction. Further, in the present embodiment, four communication holes 878 are equidistantly provided in the circumferential direction.

As shown in FIGS. 21 and 22, in the present embodiment, the gear sleeve 87 is also supported by the spindle 3 in front of the retainer 83 to be rotatable and movable in the front-rear direction relative to the spindle 3. Further, portions of the tapered sleeve 41, the retainer 83 and the rollers 45 and the biasing spring 49 are arranged in the internal space of the gear sleeve 87.

In the present embodiment, the smaller-diameter side end (front end) of the biasing spring 49 is held in contact with the washer 493 which is held in contact with the inner ring 483 of the bearing 48, while the larger-diameter side end (rear end) of the biasing spring 49 is held in contact with the front surface of the flange part 832 of the retainer 83. The biasing spring 49 always biases the retainer 83 and the gear sleeve 87 in directions away from each other, that is, respectively in rearward and forward directions. Thus, the retainer 83 is held in a position where the rear surface of the bottom wall 831 gets into contact with a front end surface of the tapered sleeve 41 by the biasing force of the biasing spring 49, and thus restricted from moving in the front-rear direction. Further, the rollers 45 are held between the rear surface of the flange part 832 of the retainer 83 and the front end surface of the base 143 and restricted from moving in the front-rear direction. As described in the first embodiment, the manner of "being restricted from moving" herein does not mean the manner of being completely prevented from moving, and slight movement may be allowed. Further, since the gear sleeve 87 is biased forward by the biasing force of the biasing spring 49, the spindle 3 is also biased forward and held in the initial position.

Operation of the power-transmitting mechanism 8 having the above-described structure is substantially the same as those of the power-transmitting mechanisms 4 and 6 of the first and second embodiments. Specifically, in the initial state, the spindle 3 is held in the initial position by the biasing force of the biasing spring 49, and the rollers 45 are held in non-frictional-contact with the tapered surface 411 of the tapered sleeve 41 and the tapered surface 875 of the gear sleeve 87. Thus, the power-transmitting mechanism 8 is in the interruption state. Thereafter, when the spindle 3 is pushed rearward against the biasing force of the biasing spring 49, the gear sleeve 87 moves toward the tapered sleeve 41, the retainer 83 and the rollers 45. Then, the rollers 45 retained by the retainer 83 are held between the tapered surface 411 and the tapered surface 875 in frictional contact therewith. Thus, the power-transmitting mechanism 8 is shifted from the interruption state to the transmission state.

As described above, the screwdrivers 1, 100 and 110 of the above-described first, second and third embodiments have the so-called planetary-roller-type power-transmitting mechanisms 4, 6 and 8, respectively. In the power-transmitting mechanism 4, 6, 8, each of the rollers 45 serving as the planetary member is at least partially disposed between the tapered surface 411 of the tapered sleeve 41 serving as the sun member and the tapered surface 475, 675, 875 of the gear sleeve 47, 67, 87 serving as the ring member in the radial direction of the spindle 3 relative to the driving axis A1 (the direction orthogonal to the driving axis A1). The gear sleeve 47, 67, 87 moves in the front-rear direction together with the spindle 3 relative to the tapered sleeve 41. On the other hand, the rollers 45 are restricted from moving in the front-rear direction relative to the body housing 11 by the biasing spring 49 (and the washer 491 or the retainer 83). This can reduce the possibility that the rollers 45 move in the front-rear direction along with the movement of the gear sleeve 47, 67, 87 relative to the tapered sleeve 41, which may result in unstable fictional contact between the rollers 45 and the tapered surface 411 and between the rollers 45 and the tapered surface 475, 675, 875. Further, in the third embodiment, the rollers 45 are restricted from moving in the front-rear direction not via the washer 491 but via the retainer 83. Thus, the number of parts can be reduced and ease of assembling can be enhanced.

In each of the above-described first to third embodiments, the retainer 43, 83 serving as the carrier member is held by the spindle 3 so as to be movable in the front-rear direction relative to the spindle 3. In other words, the retainer 43, 83 is independent from the spindle 3 in terms of movement of in the front-rear direction. The retainer 43, 83 needs to be positioned to retain the rollers 45 such that the rollers 45 do not come off from between the tapered surface 411 and the tapered surface 475, 675, 875. In the above-described embodiment, regardless of movement of the spindle 3, the retainer 43, 83 can be held in an appropriate position. Therefore, compared with a structure in which the retainer 43, 83 moves together with the spindle 3 in the front-rear direction, restrictions on an amount of movement of the spindle 3 in the front-rear direction can be reduced. Particularly, when the rollers 45 and the tapered surface 411, 475, 675, 875 are worn, the spindle 3 needs to be pushed up to a position (further rearward) where the tapered sleeve 41 and the gear sleeve 47, 67, 87 are closer to each other in order to establish stable frictional contact therebetween. Thus, the amount of movement of the spindle 3 in the front-rear direction needs to be increased. The power-transmitting mechanism 4, 6, 8 according to each of the above-described embodiments is also capable of appropriately meeting such needs.

In each of the above-described first to third embodiments, the retainer 43, 83 is held so as to be non-rotatable around the driving axis A1 relative to the spindle 3 and configured to rotate together with the spindle 3 by the power transmitted via the rollers 45. Thus, in each of the above-described embodiments, the rational planetary-roller-type power-transmitting mechanism 4, 6, 8 is realized having the retainer 43, 83 serving as an output member.

In each of the above-described first to third embodiments, the biasing spring 49 restricts not only the rollers 45 but also the retainer 43, 83 from moving in the front-rear direction relative to the body housing 11. Thus, an appropriate positional relationship can be more reliably maintained between the rollers 45 and the retainer 43, 83. Further, in each above-described embodiment, the biasing spring 49 biases the spindle 3 and the retainer 43, 83 respectively forward and rearward to move away from each other. The spindle 3 is normally held in the foremost position (initial position) by the biasing force of the biasing spring 49. By provision of such a structure, when the push of the spindle 3 is released, the spindle 3 can be returned to the initial position while movement of the retainer 43, 83 is restricted.

In each of the above-described first to third embodiments, the gear sleeve 47, 67, 87 is supported by the spindle 3 to be movable together with the spindle 3 in the front-rear direction and rotatable around the driving axis A1. The biasing spring 49 is disposed between the retainer 43, 83 and the gear sleeve 47, 67, 87 (more specifically, the bearing 48 disposed within the gear sleeve 47, 67, 87) in the front-rear direction, but the end portion of the biasing spring 49 on the gear sleeve 47, 67, 87 side is received by the washer 493 which is isolated from rotation of the gear sleeve 47, 67, 87. Therefore, rotation (so-called corotation) of the biasing spring 49 together with the gear sleeve 47, 67, 87 and heat generation of a sliding portion between the biasing spring 49 and the gear sleeve 47, 67, 87 can be prevented.

In each of the above-described first to third embodiments, the biasing spring 49 biases the gear sleeve 47, 67, 87 and the retainer 43, 83 respectively rearward and forward to move away from each other. In other words, the biasing spring 49 also has a function of biasing the gear sleeve 47, 67, 87 and the retainer 43, 83, which respectively serve as a driving-side member and a driven-side member in the power-transmitting mechanism 4, 6, 8, in directions to interrupt power transmission. Thus, a plurality of functions of restricting movement of the retainer 43, 83 in the front-rear direction and interrupting power transmission can be realized without increasing the number of parts by utilizing the biasing spring 49.

Further, in the above-described third embodiment, the communication holes 878 for providing communication between the inside and the outside of the gear sleeve 87 are formed in the peripheral wall 874 of the gear sleeve 87. Therefore, an air flow can be generated through the communication holes 878 by centrifugal force generated by rotation of the gear sleeve 87. This can realize suppression of local temperature rise, and smoother circulation of lubricants (such as grease) provided in the front housing 13. As a result, wear of the rollers 45 and the tapered surfaces 411, 475, 675, 875 can be effectively reduced, so that durability can be improved. Further, abrasion powder, if generated, can be effectively discharged to the outside of the gear sleeve 87 through the communication holes 878 together with the air flow, which may also help protect the bearing 48.

The above-described embodiments are mere examples, and a work tool according to the present invention is not limited to the structures of the screwdrivers 1, 100, 110 of the above-described embodiments. For example, the following modifications may be made. Further, any one or more of these modifications may be used independently or in combination with any one of the screwdrivers 1, 100, 110 of the above-described embodiments and the claimed invention.

In each of the above-described embodiments, the screwdriver 1, 100, 110 is described as an example of a screw-tightening tool, but the present invention can also be applied to other work tools configured to rotationally drive a tool accessory. For example, it can also be applied to a drilling tool (such as an electric drill) which performs a drilling operation by rotationally driving a drill bit, and a polishing tool (such as an electric sander) which performs a polishing operation by rotationally driving an abrasive material (such as sandpaper).

In the power-transmitting mechanism 4, 6, 8 formed as the planetary-roller-type friction clutch mechanism, the structures and arrangements of the sun member, the ring member, the carrier member and the planetary rollers may be appropriately changed. For example, the power-transmitting mechanism 4, 6, 8 need not have a so-called solar-type structure in which the sun member is non-rotatably fixed to the body housing 11 like in the above-described embodiments, but it may have a so-called planetary-type structure in which the ring member is fixed, or a so-called star-type structure in which the carrier member is fixed. Further, each of the above-described embodiments describes a structure example in which the gear sleeve 47, 67, 87 serving as the ring member moves in the front-rear direction relative to the tapered sleeve 41 serving as the sun member, but it may be acceptable that either one of the sun member and the ring member moves together with the spindle 3 as long as the sun member and the ring member have respective tapered surfaces inclined relative to the driving axis A1 in parallel to each other and can move in the front-rear direction relative to each other. Further, one of the sun member and the ring member which moves together with the spindle 3 may be integrally formed with the spindle 3 as an output member.

In each of the above-described embodiments, the biasing spring 49 has not only a function of restricting the rollers 45 serving as the planetary members from moving in the front-rear direction, but also functions of restricting the retainer 43 serving as the carrier member from moving in the front-rear direction, biasing the spindle 3 toward the initial position, and biasing the gear sleeve 47, 67, 87 serving as the driving side member and the retainer 43, 83 serving as the driven side member in the power transmitting member 4, 6, 8 in directions to interrupt power transmission. Thus, the single biasing spring 49 exerts a plurality of functions. However, these functions may be respectively realized by separate members (for example, spring members).

The number, arrangement position, shape and size of the communication holes 878, if provided, are not limited to those in the third embodiment and may be appropriately changed. For example, at least one communication hole 878 may be provided in any position within the region R1 (see FIG. 23) between the rear end of the peripheral wall 874 and the rear end of the bearing 48. Further, the communication hole 878 may extend obliquely with respect to the radial direction, or extend not in a linear form but in a curved form.

Apart from the power-transmitting mechanism 6, 7, 8, the structures of the body housing 11, the motor 2, the spindle 3 and the position-switching mechanism 5, 7 may also be appropriately changed. For example, a DC brushless motor to be powered by a rechargeable battery may be adopted as the motor 2. The position-switching mechanism 5, 7 may be omitted.

Correspondences between the features of the above-described embodiments and the modifications and the features of the invention are as follows. The screwdriver 1, 100, 110 is an example of the "work tool" according to the present invention. The driver bit 9 is an example of the "tool accessory" according to the present invention. The body housing 11 is an example of the "housing" according to the present invention. The spindle 3 is an example of the "spindle" according to the present invention. The driving axis A1 is an example of the "driving axis" according to the present invention. The motor 2 is an example of the "motor" according to the present invention. The power-transmitting mechanism 4, 6, 8 is an example of the "power-transmitting mechanism" according to the present invention. The tapered sleeve 41 is an example of the "sun member" according to the present invention. The gear sleeve 47, 67, 87 is an example of the "ring member" according to the present invention. The retainer 43, 83 is an example of the "carrier member" according to the present invention. The roller 45 is an example of the "planetary roller" according to the present invention. The tapered surface 411 is an example of the "first tapered surface" according to the present invention. The tapered surface 475, 675, 875 is an example of the "second tapered surface" according to the present invention. The biasing spring 49 is an example of the "restricting member" and the "spring member" according to the present invention. The washer 493 is an example of the "receiving member" according to the present invention. The communication hole 878 is an example of the "communication hole" according to the present invention. The region R2 is an example of the "region corresponding to the second tapered surface" according to the present invention. The region R3 is an example of the "a region that is different from a region corresponding to the second tapered surface" according to the present invention.

In view of the nature of the present invention and the above-described embodiment, the following structures (aspects) are provided. Any one or more of the following structures may be employed in combination with any of the screwdrivers 1, 100, 110 of the embodiments and its modifications, and the claimed invention.

(Aspect 1)

The ring member may have a cylindrical peripheral wall surrounding the spindle in a circumferential direction around the driving axis, the cylindrical peripheral wall having an inner peripheral surface including the second tapered surface, the carrier member may be at least partially disposed within an internal space of the ring member defined by the spindle and the inner peripheral surface, and the spring member may be disposed within the internal space in front of the carrier member.

According to the present aspect, the internal space of the ring member can be effectively utilized to arrange the spring member, so that the power-transmitting mechanism can be kept compact.

(Aspect 2)

In aspect 1, the ring member may have a stopper part disposed in front of the spring member, and the spring member may be disposed between the carrier member and the stopper part in the front-rear direction.

(Aspect 3)

In aspect 2, the stopper part may be a bearing having an inner ring rotatably supported by the spindle and an outer ring fixed to the inner peripheral surface.

According to aspects 2 and 3, the spring member can be rationally disposed between the carrier member and the ring member in the front-rear direction. The bearing 48 is an example of the "stopper part" and the "bearing" in aspects 1 and 2.

(Aspect 4)

The ring member may have a cylindrical peripheral wall part centered around the driving axis, and the communication hole may be a through hole extending through the peripheral wall part.

(Aspect 5)

An inner peripheral surface of the ring member may include the second tapered surface and a cylindrical surface extending along the driving axis, and the communication hole may be provided in a region of the ring member which corresponds to the cylindrical surface.

Further, in view of the nature of the above-described embodiments, the following aspects 6 to 19 are provided for the purpose of providing a screw-tightening tool including a power-transmitting mechanism having a more rational structure. Any one or more of aspects 6 to 19 may be employed independently of the claimed invention, or in combination with any of the screwdrivers 1, 100, 110 of the embodiments and its modifications and the claimed invention.

(Aspect 6)

A screw-tightening tool, comprising:

a spindle supported to be movable along a specified driving axis and rotatable around the driving axis, the driving axis extending in a front-rear direction of the screw-tightening tool, the spindle having a front end portion configured such that a tool accessory is removably attached thereto;

a motor; and a power-transmitting mechanism including a driving member and a driven member, the driving member being rotationally driven by power transmitted from the motor in a first direction or in a second direction opposite to the first direction, the first direction corresponding to a direction in which the tool accessory tightens a screw, the second direction corresponding to a direction in which the tool accessory loosens the screw, and the driven member being configured to rotate together with the spindle around the driving axis by the power transmitted from the driving member rotating in the first direction or the second direction, wherein:

the driving member and the driven member are arranged to be movable in the front-rear direction relative to each other and configured to move toward each other in the front-rear direction in response to rearward movement of the spindle, thereby being shifted from a interruption state in which power cannot be transmitted from the driving member to the driven member, to a transmission state in which power can be transmitted from the driving member to the driven member, and the screw-tightening tool further comprises a position-switching mechanism configured to move one of the driving member and the driven member in a direction toward the other of the driving member and the driven member in the front-rear direction when the driving member is rotationally driven in the second direction in a state in which the spindle is located in a foremost position.

In the power-transmitting mechanism of the screw-tightening tool of the present aspect, in both of a case in which the driving member is rotationally driven in the first direction for a screw-tightening operation and a case in which the driving member is rotationally driven in the second direction for a screw-loosening operation, the rotational force of the driving member is transmitted to the driven member. In other words, power is transmitted via the same path during the screw-tightening operation and the screw-loosening operation. When the driving member is rotationally driven in the second direction for the screw-loosening operation in a state in which the spindle is located in the foremost position, the position-switching mechanism moves one of the driving member and the driven member in a direction toward the other of the driving member and the driven member in the front-rear direction. In other words, in the screw-loosening operation, even if the spindle is not pushed rearward, a distance between the driving member and the driven member in the front-rear direction is shortened in response to rotational driving of the driving member in the second direction. Thus, an amount of rearward movement (push) of the spindle which is required to shift the power-transmitting mechanism to the transmission state can be made smaller than that in the screw-tightening operation. In this manner, according to the present aspect, the rational power-transmitting mechanism can be realized which is capable of transmitting power via the same path during the screw-tightening operation and the screw-loosening operation and is configured such that the screw-loosening operation can be performed by a smaller amount of push than the screw-tightening operation.

Each of the screwdrivers 1, 100, 110 of the above-described embodiments is an example of the "screw-tightening tool" according to the present aspect. The spindle 3 is an example of the "spindle" according to the present aspect. The driving axis A1 is an example of the "driving axis" according to the present aspect. The motor 2 is an example of the "motor" according to the present aspect. The power-transmitting mechanism 4, 6, 8 is an example of the "power-transmitting mechanism" according to the present aspect. The gear sleeve 47, 67, 87 is an example of the "driving member" according to the present aspect. The whole of the retainer 43, 83 and the rollers 45 is an example of the "driven member" according to the present aspect, and each of the retainer 43, 83 and the rollers 45 is also an example of the "driven member" according to the present aspect. The position-switching mechanism 5, 7 is an example of the "position-switching mechanism" according to the present aspect.

In place of the planetary-roller-type friction clutch mechanism, a dog-clutch type clutch mechanism or other types of friction clutch mechanism may be adopted as the power-transmitting mechanism 4, 6, 8. For example, a single-plate or multi-plate disc clutch mechanism or a cone clutch mechanism may be adopted. Further, in the power-transmitting mechanism 4, 6, 8 formed as the planetary-roller-type friction clutch mechanism, the structures and arrangements of the sun member, the ring member, the carrier member and the planetary rollers may be appropriately changed. For example, the power-transmitting mechanism 4, 6, 8 need not have a so-called solar-type structure in which the sun member is non-rotatably fixed to the body housing 11 like in the above-described embodiments, but it may have a so-called planetary-type structure in which the ring member is fixed, or a so-called star-type structure in which the carrier member is fixed. The driving member (input member) to be driven by power of the motor 2 and the driven member (output member) to be rotated together with the spindle 3 by the power transmitted from the driving member may also be changed according to the change of the power-transmitting mechanism 4, 6. Further, the position-switching mechanism 5, 7 may move either one of the driving member and the driven member relative to the spindle 3, as long as it is capable of moving one of the driving member and the driven member toward the other in the front-rear direction when the gear sleeve 47 is rotationally driven in the reverse direction in a state in which the spindle 3 is located in the initial position.

(Aspect 7)

The screw-tightening tool as defined in aspect 6, wherein the position-switching mechanism is configured to convert rotation around the driving axis into linear motion in the front-rear direction in response to rotational driving of the driving member in the second direction and thereby move the one of the driving member and the driven member.

According to the present aspect, the position-switching mechanism is configured as a motion converting mechanism. According to the present aspect, one of the driving member and the driven member can be moved with a simple structure.

(Aspect 8)

The screw-tightening tool as defined in aspect 7, wherein the position-switching mechanism is configured to move the one of the driving member and the driven member by action of a lead groove extending in a spiral form around the driving axis and a ball disposed in the lead groove.

According to the present aspect, the position-switching mechanism can be realized which can smoothly operate via the rolling ball. The lead groove 507, 707 is an example of the "lead groove" according to the present aspect. The ball 508, 708 is an example of the "ball" according to the present aspect.

The structure of converting rotation into linear motion in response to rotation of the driving member (the gear sleeves 47, 67, 87 of the above-described embodiments) in the reverse direction is not limited to the lead grooves 507, 707 and the balls 508, 708 of the above-described embodiments. For example, a structure of moving the driving member by action of a lead surface which is spirally curved around the driving axis A1 or by action of a screw groove and a screw thread threadedly engaged with the screw groove may be adopted. For example, in the first embodiment, a lead surface which is spirally curved around the driving axis A1 may be provided at least in one of a front end surface of the lead sleeve 500 and a rear end surface of the flange 34 of the spindle 3. Such change may be similarly made in the second embodiment. The numbers and structures of the lead grooves 507, 707 and the balls 508, 708 may be appropriately changed. Further, the structure of the one-way clutch 50 of the first embodiment may be appropriately changed, as long as the one-way clutch 50 is configured to rotate the lead sleeve 500 together with the gear sleeve 47 only when the gear sleeve 47 is rotationally driven in the reverse direction. Similarly, the structure of the one-way clutch 70 of the second embodiment may be appropriately changed, as long as the one-way clutch 70 is configured to prevent the lead sleeve 700 from rotating together with the gear sleeve 67 only when the gear sleeve 67 is rotationally driven in the reverse direction.

(Aspect 9)

The screw-tightening tool as defined in aspect 7 or 8, wherein:

the position-switching mechanism includes:

a moving member configured to move the driving member toward the driven member in the front-rear direction by rotating around the driving axis; and a one-way clutch configured to rotate the moving member together with the driving member around the driving axis only when the driving member is rotationally driven in the second direction.

According to the present aspect, a rational structure can be realized for promptly rotating the moving member in response to rotational driving of the driving member in the second direction and thereby moving the driving member. The lead sleeve 500 and the one-way clutch 50 are examples of the "moving member" and the "one-way clutch", respectively, according to the present aspect.

(Aspect 10)

The screw-tightening tool as defined in aspect 7 or 8, wherein:

the position-switching mechanism includes:

a rotatable member arranged to be rotatable around the driving axis; and a one-way clutch configured to allow the rotatable member to rotate together with the driving member around the driving axis relative to the spindle when the driving member is rotationally driven in the first direction, while preventing the rotatable member from rotating around the driving axis relative to the spindle when the driving member is rotationally driven in the second direction, and the position-switching mechanism is configured to move the driving member toward the driven member when the driving member rotates in the second direction relative to the rotatable member which is prevented from rotating relative to the spindle by the one-way clutch.

According to the present aspect, a rational structure can be realized for promptly moving the driving member linearly in the front-rear direction in response to rotational driving of the driving member in the second direction. The flange sleeve 700 and the one-way clutch 70 are examples of the "rotatable member" and the "one-way clutch", respectively, according to the present aspect.

(Aspect 11)

A screw-tightening tool, comprising:

a spindle supported to be movable along a specified driving axis and rotatable around the driving axis, the driving axis extending in the front-rear direction of the screw-tightening tool, the spindle having a front end portion configured such that a tool accessory is removably attached thereto;

a motor;

a power-transmitting mechanism including a driving member and a driven member, the driving member being rotationally driven by power transmitted from the motor in a first direction or in a second direction opposite to the first direction, the first direction corresponding to a direction in which the tool accessory tightens a screw, the second direction corresponding to a direction in which the tool accessory loosens the screw, and the driven member being configured to rotate together with the spindle around the driving axis by the power transmitted from the driving member rotating in the first direction or the second direction, wherein:

the driving member and the driven member are arranged to be movable in the front-rear direction relative to each other and configured to move toward each other in the front-rear direction in response to rearward movement of the spindle, thereby being shifted from a interruption state in which power cannot be transmitted from the driving member to the driven member, to a transmission state in which power can be transmitted from the driving member to the driven member, the power-transmitting mechanism is configured such that, an amount by which the spindle moves rearward until the power-transmitting mechanism is shifted from the interruption state to the transmission state when the driving member is rotationally driven in the second direction is smaller than the amount when the driving member is rotationally driven in the first direction.

In the power-transmitting mechanism of the screw-tightening tool of the present aspect, in both of a case in which the driving member is rotationally driven in the first direction for a screw-tightening operation and a case in which the driving member is rotationally driven in the second direction for a screw-loosening operation, the rotational force of the driving member is transmitted to the driven member. In other words, power is transmitted via the same path during the screw-tightening operation and the screw-loosening operation. Further, the power-transmitting mechanism is configured such that an amount of rearward movement (push) of the spindle which is required to shift the power-transmitting mechanism to the transmission state is smaller in the screw-loosening operation than in the screw-tightening operation. In this manner, according to the present aspect, the rational power-transmitting mechanism can be realized which is capable of transmitting power via the same path during the screw-tightening operation and the screw-loosening operation and is configured such that the screw-loosening operation can be performed by a smaller amount of push than a screw-tightening operation.

(Aspect 12)

The screw-tightening tool as defined in any one of aspects 6 to 11, wherein the power-transmitting mechanism is configured as a friction type clutch mechanism.

According to the present aspect, compared with a dog-clutch type clutch mechanism, generation of noise during engagement between the driving member and the driven member and wear of the engagement parts can be reduced.

(Aspect 13)

The screw-tightening tool as defined in any one of aspects 6 to 12, wherein the power-transmitting mechanism is configured as a planetary speed-reducing mechanism.

According to the present aspect, both the power transmitting/transmission interrupting function and the speed reducing function can be realized by a single power-transmitting mechanism.

(Aspect 14)

The screw-tightening tool as defined in any one of aspects 6 to 13, wherein the driving member has second gear teeth engaged with first gear teeth provided on an output shaft of a motor.

According to the present aspect, a rational structure for efficiently transmitting power from the motor to the power-transmitting mechanism can be realized. The pinion gear 24 and the gear teeth 470 are examples of the "first gear teeth" and the "second gear teeth", respectively, according to the present aspect.

(Aspect 15)

The spindle may have a protruding part protruding radially relative to the driving axis, the position-switching mechanism may include a movable member supported by the spindle behind the protruding part and in front of the driving member so as to be rotatable around the driving axis and movable in the front-rear direction, the screw-tightening tool may further include a biasing member which biases the movable member and the spindle forward via the driving member, and the movable member may be configured to rotate in response to rotational driving of the driving member in the second direction and move rearward relative to the spindle against biasing force of the biasing member, thereby moving the driving member rearward relative to the spindle.

According to the present aspect, the position-switching mechanism can be realized with a simple structure by using the movable member and the biasing member. The flange 34 is an example of the "protruding part" according to the present aspect. The lead sleeve 500 is an example of the "movable member" according to the present aspect. The biasing spring 49 is an example of the "biasing member" according to the present aspect.

(Aspect 16)

In aspect 15, the position-switching mechanism may include:

a lead groove formed in a front end surface of the movable member and extending spirally around the driving axis; and a ball disposed in the lead groove, and the movable member may be configured to rotate in response to rotational driving of the driving member in the second direction and move rearward relative to the spindle by action of the lead groove and the ball.

(Aspect 17)

In aspect 15 or 16, the position-switching mechanism may include a one-way clutch configured to rotate the movable member around the driving axis together with the driving member only when the driving member is rotationally driven in the second direction.

(Aspect 18)

The rotatable member may have a protruding part protruding radially relative to the driving axis and disposed in front of the driving member, the screw-tightening tool may further include a biasing member which biases the rotatable member and the spindle forward via the driving member, and the driving member may be configured to move rearward relative to the rotatable member against biasing force of the biasing member while rotating in the second direction.

According to the present aspect, the position-switching mechanism can be realized with a simple structure by using the rotatable member and the biasing member. The flange 34 is an example of the "protruding part" according to the present aspect. The lead sleeve 500 is an example of the "movable member" according to the present aspect. The biasing spring 49 is an example of the "biasing member" according to the present aspect.

(Aspect 19)

In aspect 18, the position-switching mechanism may include:

a lead groove formed in a front end surface of the driving member and extending spirally around the driving axis; and a ball disposed in the lead groove, in contact with a rear surface of the protruding part, and the driving member may be configured to move rearward relative to the spindle by action of the lead groove and the ball while rotating in the second direction.

DESCRIPTION OF NUMERALS

1, 100: screwdriver, 10: body, 11: body housing, 12: rear housing, 13: front housing, 135: stopper part, 14: central housing, 141: partition wall, 143: base, 15: locator, 17: handle, 171: grip part, 173: trigger, 174: main switch, 175: changing lever, 176: rotation-direction switch, 178: controller, 179: power cable, 18: handle housing, 2: motor, 21: rotor, 23: motor shaft, 231: bearing, 233: bearing, 24: pinion gear, 25: fan, 3: spindle, 301: bearing, 31: front shaft, 311: bit-insertion hole, 32: rear shaft, 321: groove, 34: flange, 36: ball, 4, 6: power-transmitting mechanism, 41: tapered sleeve, 411: tapered surface, 414: recess, 43: retainer, 431: bottom wall, 432: recess, 434: retaining arm, 45: roller, 47, 67: gear sleeve, 470, 670: gear teeth, 471, 671: bottom wall, 474, 674: peripheral wall, 475, 675: tapered surface, 48: bearing, 481: outer ring, 483: inner ring, 49: biasing spring, 491: washer, 493: washer, 5, 7: position-switching mechanism, 50, 70: one-way clutch, 500: lead sleeve, 501: cam groove, 502: ball, 504: peripheral wall, 505: bottom wall, 507, 707: lead groove, 508, 708: ball, 53: thrust bearing, 700: flange sleeve, 701: peripheral wall, 703: flange, 9: driver bit, 90: screw, 900: workpiece, A1: driving axis

The invention claimed is:

1. A work tool configured to rotationally drive a tool accessory, the work tool comprising:

a housing;

a spindle supported by the housing so as to be movable along a driving axis and rotatable around the driving axis, the driving axis extending in a front-rear direction of the work tool, the spindle having a front end portion configured such that the tool accessory can be removably attached thereto;

a motor housed in the housing;

a power-transmitting mechanism housed in the housing and including a sun member, a ring member, a carrier member and a planetary roller, the sun member, the ring member and the carrier member being coaxial with the driving axis, the planetary roller being rotatably retained by the carrier member; and a restricting member configured to restrict the planetary roller from moving both forward and rearward in the front-rear direction relative to the housing, wherein:

the sun member has a first tapered surface and the ring member has a second tapered surface, the first tapered surface and the second tapered surface being inclined relative to the driving axis, one of the sun member and the ring member is configured to move with the spindle in the front-rear direction relative to another of the sun member and the ring member, the planetary roller is at least partially between the first tapered surface and the second tapered surface in a radial direction to the driving axis, the power-transmitting mechanism is configured to:

transmit power of the motor to the spindle when the sun member and the ring member relatively move toward each other in response to rearward movement of the spindle and the planetary roller is in frictional contact with the sun member and the ring member, and interrupt transmission of the power when the sun member and the ring member relatively move away from each other in response to forward movement of the spindle and the planetary roller is not in contact with the sun member and the ring member or is in insufficient contact with the sun member and the ring member to transmit the power from the motor to the spindle via the sun member, the planetary roller and the ring member, and the restricting member is configured to restrict the planetary roller from moving both forward and rearward relative to the housing both (i) when the planetary roller is in frictional contact with the sun member and the ring member and (ii) when the planetary roller is in insufficient contact with the sun member and the ring member to transmit the power from the motor to the spindle via the sun member, the planetary roller and the ring member.

2. The work tool as defined in claim 1, wherein the carrier member is slidably retained by the spindle to be movable in the front-rear direction relative to the spindle.

3. The work tool as defined in claim 2, wherein the carrier member is not rotatable around the driving axis relative to the spindle and configured to rotate with the spindle by the power transmitted via the planetary roller.

4. The work tool as defined in claim 1, wherein the restricting member is configured to restrict the carrier member from moving both forward and backward in the front-rear direction relative to the housing.

5. The work tool as defined in claim 4, wherein:

the restricting member includes a spring member which biases the spindle forward and the carrier member rearward to move away from each other, and the spindle is held in a foremost position by biasing force of the spring member.

6. The work tool as defined in claim 5, wherein:

the ring member is supported by the spindle so as to be movable in the front-rear direction with the spindle and rotatable around the driving axis, and the spring member is between the carrier member and the ring member in the front-rear direction, and the work tool further comprises a receiving member that receives one end of the spring member while the spring member is isolated from rotation of the ring member.

7. The work tool as defined in claim 6, wherein:

the ring member is configured to be rotated by the power of the motor, and the spring member is configured to bias the ring member and the carrier member to move away from each other in the front-rear direction.

8. The work tool as defined in claim 1, wherein the ring member has at least one communication hole that provides communication between an inside and an outside of the ring member.

9. The work tool as defined in claim 8, wherein the communication hole is in a region of the ring member that does not include the second tapered surface.

10. The work tool as defined in claim 5, wherein:

the ring member has a cylindrical peripheral wall surrounding the spindle in a circumferential direction around the driving axis, the cylindrical peripheral wall having an inner peripheral surface including the second tapered surface, the carrier member is at least partially within an internal space of the ring member defined by the spindle and the inner peripheral surface, and the spring member is within the internal space in front of the carrier member.

11. The work tool as defined in claim 10, further comprising:

a bearing in front of the spring member within the ring member, wherein:

the bearing includes an inner ring rotatably supported by the spindle and an outer ring fixed to the inner peripheral surface of the ring member, and the spring member is between the carrier member and the bearing in the front-rear direction.

12. The work tool as defined in claim 8, wherein:

the ring member has a cylindrical peripheral wall part centered around the driving axis, and the communication hole is a through hole extending through the peripheral wall part in a radial direction of the ring member.

13. The work tool as defined in claim 3, wherein the restricting member is configured to restrict the carrier member from moving in the front-rear direction relative to the housing.

14. The work tool as defined in claim 13, wherein:

the restricting member includes a spring member which biases the spindle forward and the carrier member rearward to move away from each other, and the spindle is held in a foremost position by biasing force of the spring member.

15. The work tool as defined in claim 14, wherein:

the ring member is supported by the spindle so as to be movable in the front-rear direction with the spindle and rotatable around the driving axis, and the spring member is between the carrier member and the ring member in the front-rear direction, and the work tool further comprises a receiving member that receives one end of the spring member while the spring member is isolated from rotation of the ring member.

16. The work tool as defined in claim 15, wherein:

the ring member is configured to be rotated by the power of the motor, and the spring member is configured to bias the ring member and the carrier member to move away from each other in the front-rear direction.

17. The work tool as defined in claim 4, wherein:

the restricting member is a spring;

a portion of the carrier member is between the planetary roller and the spring in the front-rear direction; and the spring biases the carrier member rearward in the front-rear direction to hold the carrier member in a predetermined position relative to the housing, to restrict movement of the planetary roller.

18. The work tool as defined in claim 17, wherein:

the carrier member includes:

a wall part with a through-hole through which the spindle is received; and retaining arms that extend rearward from the wall part and define a retaining space for the planetary roller; and a front part of the retaining space is defined by a portion of the wall part.

19. A work tool configured to rotationally drive a tool accessory, the work tool comprising:

a housing;

a spindle supported by the housing so as to be movable along a driving axis and rotatable around the driving axis, the driving axis extending in a front-rear direction of the work tool, the spindle having a front end portion configured such that the tool accessory can be removably attached thereto;

a motor housed in the housing;

a power-transmitting mechanism housed in the housing and including a sun member, a ring member, a carrier member and a planetary roller, the sun member, the ring member and the carrier member being coaxial with the driving axis, the planetary roller being rotatably retained by the carrier member; and a restricting member configured to restrict the planetary roller from moving both forward and rearward in the front-rear direction relative to the housing, wherein:

the sun member has a first tapered surface and the ring member has a second tapered surface, the first tapered surface and the second tapered surface being inclined relative to the driving axis, one of the sun member and the ring member is configured to move with the spindle in the front-rear direction relative to another of the sun member and the ring member, the planetary roller is at least partially between the first tapered surface and the second tapered surface in a radial direction to the driving axis, the spindle and the power-transmitting mechanism are configured to:

transmit power of the motor to the spindle when the planetary roller is in frictional contact with the sun member and the ring member, and interrupt transmission of the power when the planetary roller is not in contact with the sun member and the ring member or is in contact with only one of the sun member and the ring member, and the restricting member is configured to restrict the planetary roller from moving both forward and rearward relative to the housing (i) when the planetary roller is in frictional contact with the sun member and the ring member, (ii) when the planetary roller is not in contact with the sun member and the ring member and (iii) when the planetary roller is in contact with only one of the sun member and the ring member.

* * * * *